US005848513A

United States Patent [19]

Leslie et al.

[11] Patent Number: 5,848,513

[45] Date of Patent: Dec. 15, 1998

[54] BUILDING JIG AND BOX BEAM THEREFOR

[75] Inventors: Robert H. Leslie, Edina; Robert J. Leslie, Richfield, both of Minn.

[73] Assignee: International Building Concepts, Ltd., Anoka, Minn.

[21] Appl. No.: 794,429

[22] Filed: Feb. 5, 1997

Related U.S. Application Data

[60] Provisional application No. 60/011,265 Feb. 7, 1996.

[51] Int. Cl.[6] ..... E04C 3/12

[52] U.S. Cl. ..... 52/731.2; 52/264; 52/270; 52/284; 52/726.2; 52/729.2; 52/729.4

[58] Field of Search ..... 52/264, 265, 267, 52/270, 274, 284, 292, 588.1, 591.1, 591.3, 592.2, 650.1, 651.11, 653.1, 656.1, 731.2, 731.3, 726.2, 729.2, 729.4, 783.1

[56] References Cited

U.S. PATENT DOCUMENTS

| | | | |
|---|---|---|---|
| 1,372,206 | 3/1921 | Stadelman | 52/92.1 |
| 1,377,891 | 5/1921 | Knight | 52/729.4 X |
| 2,309,451 | 1/1943 | Hasenburger et al. | 52/274 X |
| 2,600,900 | 6/1952 | McNeill . | |
| 2,996,157 | 8/1961 | Rauth . | |
| 3,299,594 | 1/1967 | Kellert . | |
| 3,339,327 | 9/1967 | Kempf | 52/591.1 X |
| 3,605,350 | 9/1971 | Bowers | 52/274 X |
| 3,738,083 | 6/1973 | Shimano . | |
| 3,919,819 | 11/1975 | Oliver . | |
| 3,921,355 | 11/1975 | Pennecot . | |
| 3,960,637 | 6/1976 | Ostrow | 52/729.2 X |
| 4,001,986 | 1/1977 | Kozak . | |
| 4,005,556 | 2/1977 | Tuomi | 52/653.1 X |
| 4,055,924 | 11/1977 | Beaver, Jr. . | |
| 4,082,356 | 4/1978 | Johnson . | |
| 4,272,930 | 6/1981 | Foster . | |
| 4,464,877 | 8/1984 | Gebhardt et al. . | |
| 4,467,585 | 8/1984 | Busby . | |
| 4,523,418 | 6/1985 | McLaughlin . | |
| 4,569,664 | 2/1986 | Giampetruzzi et al. . | |
| 4,630,418 | 12/1986 | Degut . | |
| 4,677,806 | 7/1987 | Tuomi | 52/729.4 X |
| 4,843,777 | 7/1989 | Shimabukuro | 52/731.2 X |
| 5,014,476 | 5/1991 | Leslie et al. | 52/284 X |
| 5,072,554 | 12/1991 | Hayman . | |
| 5,323,584 | 6/1994 | Scarlett | 52/729.4 |
| 5,351,453 | 10/1994 | Leslie . | |

FOREIGN PATENT DOCUMENTS

| | | |
|---|---|---|
| 477325 | 9/1951 | Canada . |
| 534446 | 1/1922 | France . |
| 3512306 | 10/1986 | Germany . |

OTHER PUBLICATIONS

Home Builders International, Rendering of 600 Square Foot UniHome, Dec., 1994, Home Builders International, Minneapolis, USA.

Home Builders International, Sketches of Prefabricated Trimmer J, Prefabricated Trimmer K, Prefabricated Header L, Prefabricated Baseboard M, Prefabricated Header with Receiver, Dec., 1994, Home Builders International, Minneapolis, USA.

Home Builders International, "UniHome: Assembly Manual," Shelter Series, Home Builders International (Minneapolis), (1994).

*Primary Examiner*—Carl D. Friedman
*Assistant Examiner*—Kevin D. Wilkens

[57] ABSTRACT

A box beam incorporating an I-joist. A set of such box beams makes up a portion of the base for a shelter and provide receivers in which prefabricated wall partitions are slidingly engaged. The I-joist or I-beam includes an elongate web, two opposite flanges, and at least a first outer elongate plate member which runs parallel to the web and is fixed to and between faces of the flanges. With a single outer plate member extending beyond the upper flange, an L-shaped receiver is formed for receiving outer wall partitions which may be placed into such receiver from a horizontal direction, without manipulating the wall partition up and over and down into the receiver. With a pair of outer plate members extending beyond the upper flange, a channel receiver is formed. I-beam structures having the channel receiver are placed in the interior of the base for interior wall partitions. The I-beams support a floor and such outer and inner wall partitions which may interlock with each other.

29 Claims, 33 Drawing Sheets

10

12
14
16

12
14
18

12
14
20
20
20

22
24
26
28
30
30
30
30
14

324
332
336
342
334
296
174
178
286
294
282
320
310
314
316
300
276
266
175
256

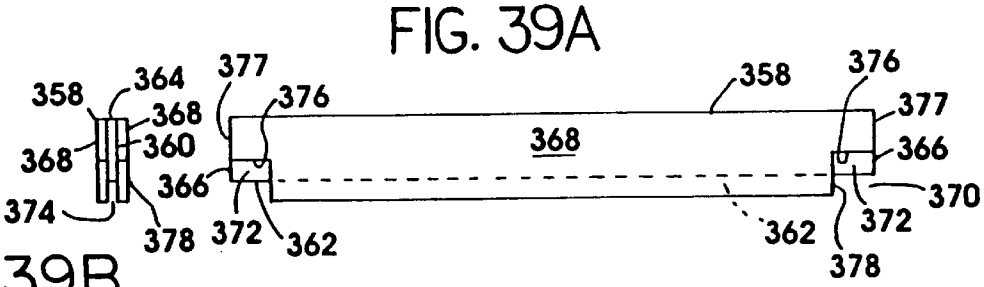
FIG. 39A
FIG. 39B
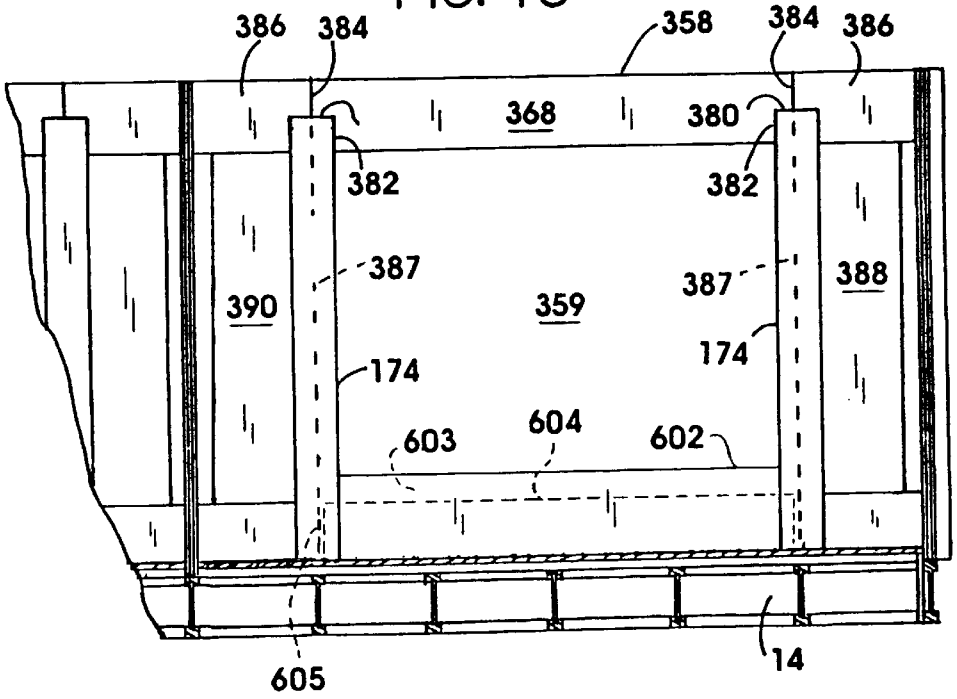
FIG. 40

402

400
402

406
418
354
408
418
400
410
420
412
418
404
404
174
174
174
174
282
140
426
422
422
424
600
600
416
414
404
174
248A
420
398
246C
140

594
536
354
542
540
538
560
332
54
530
532
356
534
502
490
492
488
500
453
498
548
544
540
534
560
332
592
562
564
502
490
492

BUILDING JIG AND BOX BEAM THEREFOR

This application claims the benefit under Title 35, United States Code §119(e) of the United States provisional application Ser. No. 60/011,265 filed Feb. 7, 1996 and entitled Monolithic Shelter. Such provisional application Ser. No. 60/011,265 is hereby incorporated by reference in its entirety into this application.

BACKGROUND OF THE INVENTION

The present invention relates generally to I-beams, more particularly to organic I-beams, and specifically to organic I-beams utilized for a base or building jig for a shelter.

A conventional I-beam includes an elongate web and a pair of flanges. The flanges are formed of layers of plywood and the web is formed of oriented strand board.

A base or building jig is perhaps the most important structural portion of a building. If a feature of the base is imperfect relative to other features of the base, such a problem manifests itself as the building rises. For example, in a prefabricated home, components such as walls and rafters may not engage each other in the desired manner. Time is lost, costs rise, and a less than sturdy structure may be the result. On the other hand, when the base is as true as practically possible, wall and rafter components fit easily and precisely. The building rises quickly. Time is saved, costs are held to a minimum, and a strong structure is the result.

The chances of providing a true base or building jig are increased when the base or building jig which is provided is simple. Even for experienced carpenters, the building of each and every base is a challenge. Ground layouts are different. Materials are likely to be different. Building codes differ. Further, houses are often erected by parties inexperienced in the art of construction. Accordingly, for at least the above reasons, when the base is simple to build, the chances of having a finished base which is true are increased.

When a base relates in a simple manner to the components which it supports, more time and money is saved in the erection of the structure. The shape of the base and its features is in and of itself a form of communication between the architect and the parties erecting the structure.

When a base relates to the components it supports in an engaging manner prior to applying adhesives or pin connectors such as nails and screws, a stronger building is the result. Such an engagement, especially when resisting forces applied to it from each of the "x,y, and z" directions, may be described as a monolithic engagement.

A combination may be relatively strong when subparts of the combination distribute loads to other subparts of the combination. So too with a base or building jig. A stronger base is one which distributes loads applied to one portion of the base throughout the entire base.

Problems identified by the present inventors in the wood rafter industry include problems in the reinforcement and alignment of rafters. First, rafters such as I-beam rafters have a web which transmits a load to and between the flanges of the I-beam. When a stronger rafter for carrying a greater load is required, a web of a greater thickness is ordered at a greater expense. Unfortunately, these thicker webs when formed of material such as oriented strand board are more expensive since such thicker webs are custom made.

Second, after the rafters have been fixed on the structure, the outer end or tail of a rafter is marked with a measuring tape and then generally cut off at the mark so as to align the rafter tails with each other for the placement of soffits or fascia about the structure. Such a process is slow and misalignment and recutting the attendant remeasuring and recutting of a rafter—or all of the rafters—occurs relatively frequently.

A soffit is the underside of a structural component, such as a beam, arch, staircase, or cornice. A soffit is "something fastened beneath." In the housing industry, a soffit conventionally contributes little if any to the structural integrity of the housing unit. On a house, a soffit typically runs the perimeter of the building under the roof overhang and between the rafter tails and the walls.

SUMMARY OF THE INVENTION

A general object of the invention is to provide a unique box beam for the building jig.

Another object of the invention is to provide an organic webbed I-beam with a pair of flanges where a panel uniquely spans the flanges on one side of the web.

Another object of the invention is to provide such a spanning panel where the panel uniquely extends beyond one of the flanges to form an L-shaped receiver.

Another object of the invention is to provide a pair of such spanning panels so as to uniquely form a channel receiver on the I-beam.

Another object of the invention is to provide a unique building jig of one or more of the I-beams having the L-shaped receivers and/or of one or more of the I-beams having the channeled receivers.

Another object of the invention is to provide such a building jig uniquely having one or more wall partitions mounted thereon in one or more of such receivers.

Another object of the invention is to provide such a building jig having such wall partitions interlocking with each other.

Another object of the invention is to provide such a building jig having wall partitions mounted on the jig and forming posts, with the posts uniquely being disposed over splices in or connections between the I-beams.

Such features of the present invention provide building jigs which are simple to assemble, inexpensive, and strong.

Another general object of the present invention is to provide a unique rafter.

Another object of the invention is to provide an I-beam rafter formed of organic matter and including three layers of organic matters between the flanges of the I-beam. One such layer is the middle layer or web which runs into and is fixed in each of the flanges. The other two layers are outer layers—or web stiffeners—on each face of the web and running to and between the inner edges of the flanges. Load is thereby transmitted to and between the flanges via the web or middle layer of organic matter and via the outer two layers of organic matter.

Another object of the present invention is to provide a unique rafter tail. Such a rafter tail is formed out of the outer two layer or web stiffeners of the rafter. Specifically, the rafter tail slidingly engages the main rafter and is slideable outwardly therefrom to permit easy lateral adjustment with each of the other rafter tails. The rafter tail slides in a track formed in the main rafter to permit rafter tails to be readily lined up. No cutting of tails is thus required.

The rafter is formed of organic matter and further includes a slideable rafter tail such that rafter tails may be easily laterally aligned with each other. The rafter tail also includes a slot which slideably engages the web of the rafter. Sections of the rafter tail run in tracks of the rafter such that load is transmitted in the vertical direction through the rafter. The rafter preferably is an I-beam formed of organic matter. The I-beam includes a web and a pair of flanges. The I-beam further includes a portion where a layer of organic matter is disposed on each face of the web between the flanges such that load is transmitted to and between the flanges via the web and via the organic layer on each side of the web. The rafter tail sections form a portion of each of the organic layers. Slideable rafter tails make it easy to line up the tails with each other and with the soffit.

Another general object of the present invention is to provide a unique roof overhang structure.

Another object of the invention is to provide a unique soffit for the roof overhang structure. Specifically, the soffit is formed of an I-beam which is engaged to and between a rafter tail and a wall structure at a generally right angle to the wall structure. The I-beam soffit provides a structural feature to an otherwise generally merely aesthetic component. Preferably the web of the I-beam or I-joist is formed of oriented strand board.

The soffit is hurricane-resistant and formed of an I-joist or I-beam for structurally tying the roof structure to a wall structure. The inner flange of the I-beam is affixed to the wall structure or exterior wall partition and the outer flange of the I-beam is affixed to the rafter tails of the rafters of the roof structure or roof overhang. The I-beam preferably is engaged at generally a right angle relative to the wall structure and may include ventilation openings. Fascia may be affixed to the outer flange. The I-beam is preferably formed of organic matter and more preferably of wood. The web of the I-beam is preferably formed of compressed wood strands arranged in layers at generally right angles to one another and bonded with a waterproof adhesive and more preferably formed of oriented strand board.

These and further objects and advantages of the present invention will become clearer in light of the following detailed description of the illustrative embodiments of this invention described in connection with the drawings.

BRIEF DESCRIPTION OF THE DRAWINGS

The illustrative embodiments may be best described by reference to the accompanying drawings where:

FIGS. 33–38A, B, C, D, E show side, top, end, bottom, and opposite end plan views, respectively, of each of the wall components of FIG. 31.

FIG. 39A shows a side view of a header for spanning an opening in one of the wall portions.

FIG. 39B shows an end view of the header of FIG. 39A.

FIG. 40 shows the header of FIG. 39A spanning an opening in one of the wall portions.

Figures 1, 2, 3, 4, 5:
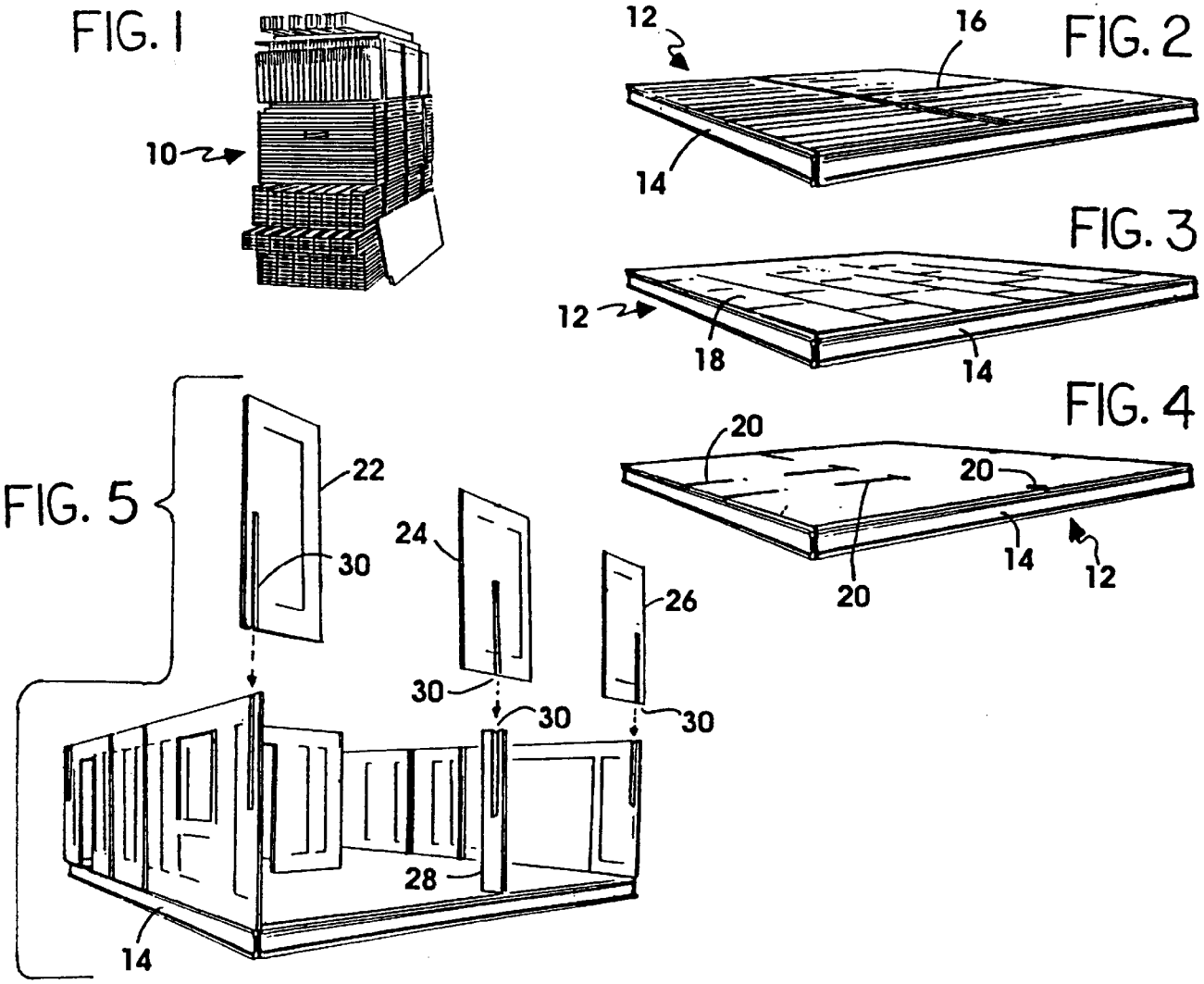
FIG. 1 shows a perspective view of a kit for the present monolithic shelter.
FIG. 2 shows a perspective view of the modified box beam and I-beam base for the monolithic shelter.
FIG. 3 shows a perspective view of the base of FIG. 2 having staggered, interlocking floor panels mounted thereupon.
FIG. 4 shows a perspective view of the base of FIG. 3 having slots cut in the floor to expose channels in box beams or I-joists for the reception of wall partitions.
FIG. 5 shows a perspective view of the base of FIG. 4 having slotted wall partitions interlocking with each other to form posts or posted beams.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various Figures of the drawings, the same numerals designate the same or similar parts. Furthermore, when the terms "inner," "outer," "side," "end, ", "upper", "lower" and similar terms are used herein, it should be understood that these terms have reference only to the structure shown in the drawings as it would appear to a person viewing the drawings and are utilized only to facilitate describing the preferred embodiments.

DESCRIPTION

The present invention may relate generally to shelters, particularly to monolithic shelters, and specifically to monolithic shelters which are quickly assembled and are inexpensive.

A monolith is a large block of stone used in architecture or sculpture. Monolithic generally means to be massive, solid and uniform The monolithic shelter of the present invention is solid and uniform, yet not massive. Such is provided by building the present shelter with relatively lightweight components and interrelating those components such that engagement between adjoining components is maximized.

A general object of the present invention is to provide a unique monolithic shelter.

Another object of the invention is to provide for such a shelter a unique box beam. Specifically, the box beam includes an I-joist with at least one outer elongate plate engaged to and running along the flanges on one side of the box beam. The outer elongate plate is flush with one flange and extends beyond the other flange to form an L-shaped receiver or groove with such flange. This receiver mounts exterior wall partitions for the shelter. In another embodiment, two outer elongate plates run opposite each other to form a channeled receiver. Such mounts interior wall partitions for the shelter.

Another object of the invention is to provide for such a shelter a unique base. The base includes I-joists with the L-shaped receiver running about the perimeter of the shelter. I-joists with the channeled receiver form cells in the interior of the shelter. Such wall supporting receiver I-joists engage each other and are engaged by still other I-joists.

Another object of the invention is to provide for such a shelter a unique prefabricated wall partition. The wall partition includes at least one preattached female receptor. The female receptor, formed of a pair of panel strips, is preattached to and extends beyond side edge portions of the partition. Post forming partitions include female receptors on both side edge portions. The female receptor is absent from the other side edge portion of other partitions so that such partitions can be mated to one another.

Another object of the invention is to provide for such a shelter a unique preattached position locator on the wall partition having the female receptor. Some of the preattached position locators abut and space apart female receptors of adjoining wall partitions.

Another object of the invention is to provide for such a shelter a unique header for an opening defined in part by a pair of vertical support members having upper end portions with slot receivers. The header includes two end portions, each of which includes a tongue engagable with one of the slot receivers. The tongue extends into a stepped or cut out portion having: 1) a pair of horizontal edges for transferring the load of the header to the support members (and vice versa) along the vertical axis, and 2) a pair of vertical edges for spacing apart the support members and transferring forces exerted in the longitudinal direction. The tongue and slot laterally relate the header and support member for supporting each other along the lateral axis.

Another object of the invention is to provide in such a shelter a unique framing arrangement for an opening. Structural components about the opening, such as the I-joists, wall partitions and headers, may include receivers or channels. Trim for the opening may include male components having conduits therein for articles such as electrical wires.

Another object of the invention is to provide in such a shelter a unique interlocking arrangement for the trim about the opening. Some cut out portions of such trim may engage each other and extend beyond the other to engage exterior and interior faces of the same wall partition to lend stiffness to the trim. Other cut out portions of such trim engage both the floor and base of the shelter.

Another object of the invention is to provide in such a shelter a unique soffit. The soffit is formed of an I-joist placed at a right angle to the exterior wall and between the exterior wall and the roof overhang for support therebetween to provide a structural purpose to an otherwise generally merely aesthetic component.

Another object of the invention is to provide for such a shelter a unique roof structure. The roof structure is formed generally of I-joists. The roof structure is mounted directly on exterior and interior wall partitions.

Another object of the invention is to maximize the use of oriented strand board. Such a component is used for the web of the I-joist, the outer plates of the modified box beam, the wall partitions, the female receptors, for upper and lower position locators, the headers, the inserts for closing off openings where doors and windows may later be added, the I-joist webs of the base and roofing beams, the floor panels, the webs for the I-beam soffits, and elsewhere such as the furring strips, blocks and tie-in plates. Oriented strand board is composed of compressed wood strands arranged in layers and bonded with fully waterproof adhesive. The wood strands are arranged in layers at right angles to one another and bonded with the waterproof adhesive.

Another object of the invention is to provide a true building jig as the base of the shelter. Such uniquely permits the wall to be mounted on and supported by the base and therefore permits almost the entire length of a piece of oriented strand board to be used as a wall partition. This maximizes the height of the walls of the home for a piece of oriented strand board of a given size.

Another object of the present invention is to uniquely provide an additional function for the female receptor mating two adjoining wall partitions. Besides functioning as support along the lateral axis for two adjoining wall partitions, the female receptors are preferably spaced equidistant from each other, such as on two-foot centers. This permits the female receptors to be used as furring strips for receiving pin connectors such as nails for the attachment of sheet rock and siding. The relatively wide female receptors, for maximizing surface area contact and lateral support, are easy targets for the carpenter. The width of a female receptor is preferably greater than the length of a hand.

Another object of the invention is to provide for such a shelter a unique rafter tail which is slideable relative to the main rafter. The rafter tail slides in a track formed in the main rafter whereby rafter tails may be readily lined up. No cutting of tails is required.

Another object of the invention is to provide for such a shelter a monolithic connection between the wall partitions and roof structure. With conventional construction methods, rafters may fly off in high winds. With the present invention, the rafter is tied to the wall partition via connection hardware, wedges, I-beam soffits, and in some instances further tie-in plate members. The wall to rafter connection distributes load along all three axes and in each direction on each of the axes so as to minimize the chances of rafters flying off walls, a direction of force which conventional methods of construction may not take into account.

An advantage of the invention is that the present monolithic shelter is solid and uniform without being unnecessarily massive. Every portion of the shell of the structure supports every other portion of the structure. Force applied to one component is distributed to each of the other components in the shell. Engagement between adjoining components is maximized along vertical, longitudinal, and lateral axes and in each direction on each of the axes. The home can withstand hurricane strength winds.

Another advantage of the invention is that the monolithic shelter is quickly and easily assembled. Most, if not all, components are prefabricated. Many components are identical. Even where not identical, components include the same features and relationships so that the learning curve for the first time assembler is minimized.

Another advantage is that the monolithic shelter is inexpensive. Components for the shelter are preferably formed of oriented strand board, which is relatively inexpensive. Further, since the shelter is easily assembled, labor costs are minimized.

Another advantage of the invention is that the monolithic shelter, though provided in kit form, may be customized by the assembler. The shell includes framing arrangements which may be closed off to serve as walls or opened for the addition of doors such as sliding glass doors or windows such as bay windows. Further, slots may be cut in floor panels to expose structural channels in which to place wall partitions.

Another advantage is that the shelter is tightly sealed. The preferred material, oriented strand board, includes a resin, and many of the components are preferably glued together; air permeates little, if any, through oriented strand board. Even the joints and male/female connections are sealed; such bonds the components as well as cutting off air flow.

Another advantage is that the shelter is monolithic even without the use of an adhesive. Although adhesive is preferred at a number of locations about the structure, adhesive may be difficult or expensive to procure, especially in developing or Third World countries. Pin connectors such as nail or screws alone may be used to engage the various components. The use of adhesive and pin connectors is more preferred to the use of an adhesive alone or the use of pin connectors alone.

Another advantage is that the floor portions throughout the shelter are flush. The floor of one cell unit is flush with the floor of an adjoining cell unit and all other units. Thresholds are absent between adjoining cell floors.

Another advantage is that the wall partitions, modified box beams, and other components fabricated from oriented strand board will not warp. Plywood warps; oriented strand board does not. Oriented strand board has no grain and hence is resistant to a change of shape.

Another advantage is that the framing components about openings are flush with each other. Such facilitates the addition of trim about the opening and the addition of sheet rock about the opening.

Another advantage is that the perimeter of each of the wall partitions is captured. Features permitting such capture include both receiver embodiments of the modified box beam, the female receptors, and the headers having receivers along their side edge portions.

Another advantage is that the shell of the monolithic shelter includes a posted beam system made of interlocking wall partitions. Such permits the roof structure to be mounted at and on the posted beams and on the wall partitions between the posted beams.

Another advantage is that exterior grade material is used inside and outside the shelter.

Another advantage is that the present invention conserves environmental resources. For example, the preferred material for many of the components, oriented strand board, uses less trees and faster growing trees than other lumber sources, such as dimensional lumber.

Another advantage is that the present monolithic structure complies with building codes of many localities and of many countries.

Another advantage is that the monolithic structure may be formed from a variety of materials besides oriented strand board, although oriented strand board is preferred. For example, structural building components such as the I-joists, wall partitions, female receptors, headers, and other components may be formed from materials which are inexpensive or abundant in the locality or country.

Another advantage is that finishing materials conventionally used in a locality or country may be used. Sheet rock and insulative material may be expensive or relatively unavailable in some countries. In some countries, sheet rock like material may be formed from concrete and natural vegetation.

Another advantage is that the height of the wall partitions is relatively great for a given size of board used to make the wall partition. For example, a piece of oriented strand board conventionally is engineered at eight feet by four feet. By mounting the wall partitions on the base via the modified box beams, the relative height of the home is increased. Further, by using the modified box beam base in combination with the preferred header having the stepped cut out and tongue, the height of doorways is relatively great.

Another advantage is that different shelters can be made with the same set of components. The components, especially the wall partitions, can be turned around or mirrored.

Another advantage is that standard accessories can be supported by the base of the monolithic home. These include washers, dryers, dishwashers, ovens, bathtubs, pianos, and other massive objects.

Another advantage is that standard systems can be incorporated. These include electrical systems, plumbing systems, heating and air conditioning systems, and other conventional systems. Rigid foam insulation may be used. Fireplaces can be built into the monolithic home. Air conditioners can be mounted on exterior wall partitions.

Another advantage is that it is relatively easy to make the monolithic home square. The modified box beams and I-joists are precut. This permits the floor base to be level and square and which hence is the building jig for the remainder of the home.

Another advantage is that the monolithic home is prefurred. In other words, it includes factory installed furring for receiving pin connectors such as nails for mounting material such as sheet rock or shelves.

Another advantage is that the roof structure can be mounted utilizing a central post and the outer posts formed by the wall partitions. Interior posts between the exterior posts and central posts can be eliminated. Hence, cells can lead fully into adjacent cells from the floor to the roof structure and from the exterior wall partition to the central post or posts. Headers and wall partitions between cells can be eliminated.

Another advantage is that the large panel size of the oriented strand board is maintained as much as possible. Such minimizes the number of joints that can permit the passage of air and heat and airborne noise. Even where joints are formed, such joints are sealed, such as by the adhesive or nature of the joint or female-male connection, to cut off air flow.

As shown in FIG. 1, the present monolithic home and/or shell therefor may be provided in the form of a kit 10. One or more kits 10 may be mounted on a truck such as a semi-trailer. Or the kits 10 may be easily and inexpensively transported by air, water, or rail means of transportation.

A foundation for the present monolithic home may be concrete or the home may be mounted on concrete blocks. The home may be mounted over a basement.

As shown in FIG. 2, after supplying a foundation, one of the first steps in building the home is forming the base 12 for the home from the components of the kit 10. The base 12 includes a set of outer modified box beams 14 with L-shaped receivers for the perimeter and modified box beams 16 with channeled receivers in the interior of the base 12.

As shown in FIG. 3, a subsequent step is to mount, such as by adhesive and/or pin connectors, floor panels 18 to the base 12. Each of the floor panels 18 is staggered relative to adjacent floor panels 18. Each of the floor panels 18 includes four side edges. Each of the side edges either includes an elongate tongue or groove for mating with a groove or tongue of an adjacent floor panel 18.

As shown in FIG. 4, the floor panels 18 may channeled out so as to form channels 20 for receiving wall partitions. If desired, the channels 20 may be prefabricated in the floor panels 18.

As shown in FIG. 5, wall partitions 22, 24, 26, and 28 may be mounted in the slots 20 and on the modified box beam 14 having the L-shaped receiver so as to form posts for the shelter. Each of the wall partitions 22, 24, 26, and 28, and each of their respective interlocking wall partitions includes a slot 30. As to such a slot and other interlocking arrangements, the Leslie U.S. Pat. No. 5,351,453 is hereby incorporated by reference in its entirety.

Figure 6:
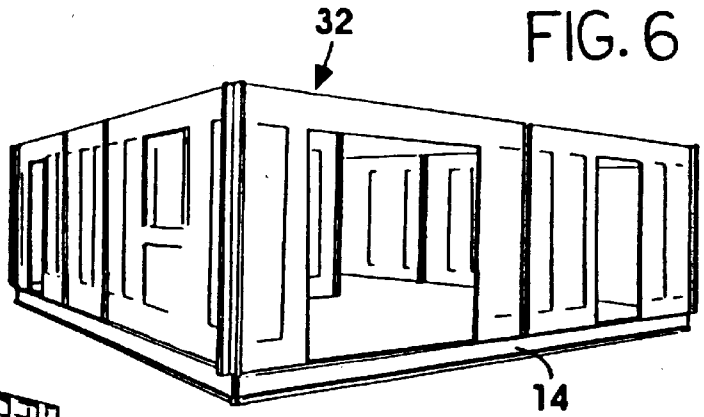
FIG. 6 shows a perspective view of the base of FIG. 5 having completed walls.
Figure 7:
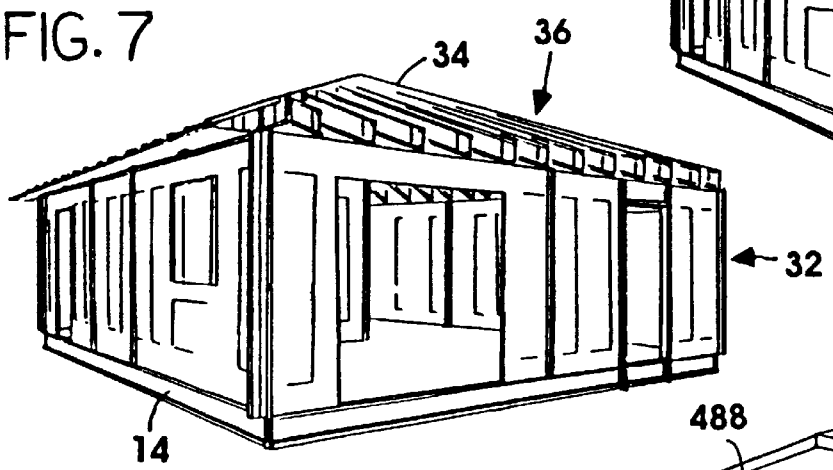
FIG. 7 shows a perspective view of the shell for the monolithic home.
Figure 8:
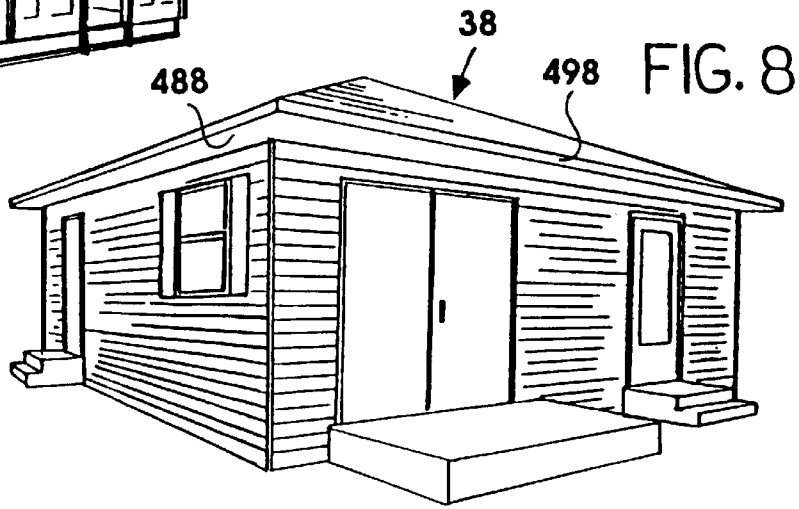
FIG. 8 shows a perspective view of the present monolithic home.

FIG. 6 shows completed shell walls 32 for the monolithic home. FIG. 7 shows a completed shell roof structure 34 on the shell walls 32 for a completed shell 36. FIG. 8 shows a finished monolithic home 38.

It should be noted that the vast majority of the components of the kit 10 are preferably formed from oriented strand board. Oriented strand board is an engineered mat-formed structural panel made of strands sliced from small diameter logs, and bonded with resin under intense heat and pressure. Since the strands are precisely cut to a uniform size and thickness, specific performance qualities can be designed into the panel by cross-aligning layers of wood strands for maximum length. Oriented strand board formed with an aligned face and a random core or an aligned face with a oriented core are preferred. The resin is fully waterproof, and is preferably a waterproof phenolic resin. Oriented strand board possesses great strength and stiffness resulting from the cross-laminated layers. Oriented strand board will not warp. The preferred oriented strand board is graded Exposure I and Structural I. Oriented strand board is not "particle board." Neither is it "flakeboard." Oriented strand board meets performance standards based on the end use for the board. The three basic criteria for qualifying oriented strand board include structural adequacy, dimensional stability and bond durability. Tests for such criteria include linear expansion, racking, uniform load, concentrated static load, impact resistance, direct fastener withdrawal, and lateral fastener strength. Oriented strand board panels are strong. Such panels resist racking and shape distortion under high wind and earthquake forces. Such panels exhibit excellent fastener-holding capability, even when nailed close to the panel edge. Relative to its strength, oriented strand board is lightweight. Such panels have stiffness to resist deflection and bending. They absorb shock. They are made from wood, a natural insulator, and provide protection from heat loss and condensation.

Figure 9:
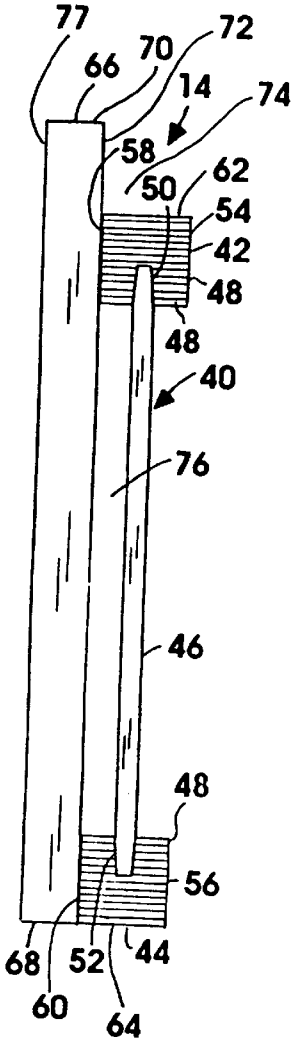
FIG. 9 shows an end view of the modified box beam for the perimeter of the base.
Figure 12:
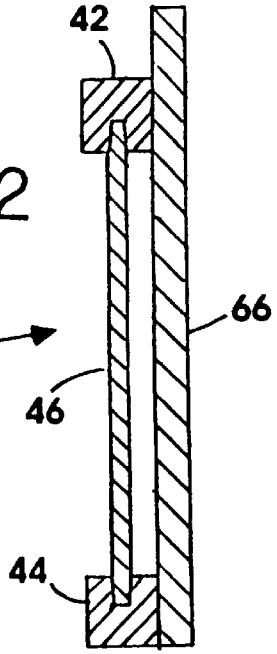
FIG. 12 shows a section view of another embodiment of the modified box beam utilized for mounting exterior wall partitions.
Figure 13:
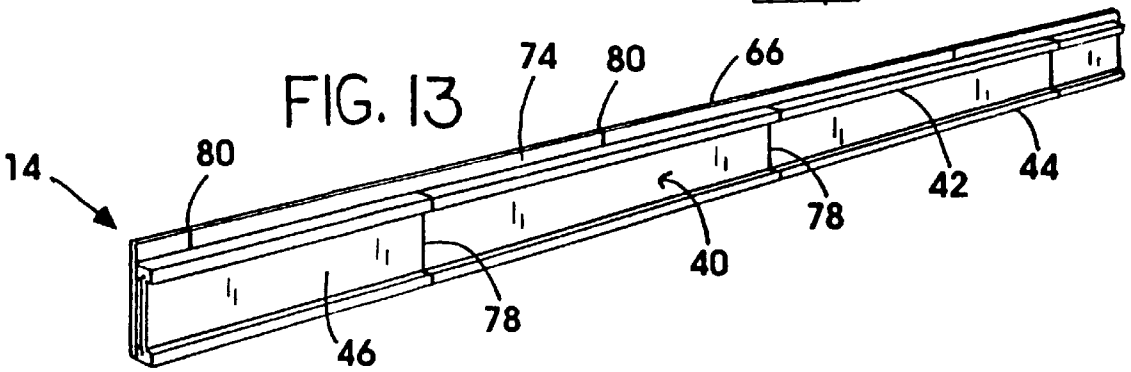
FIG. 13 shows a perspective view of the modified box beam of FIG. 12 and illustrates the spanning and staggering of terminating portions.

More specifically, as shown in FIGS. 9, 12, and 13, the modified box beam 14 for forming the perimeter of the base 12 includes an I-beam portion 40 with a pair of elongate flanges 42, 44, and an elongate web 46 between the flanges 42, 44. Each of the flanges 42, 44, is formed of a plurality of layers 48 of plywood or dimensional lumber fixed together under pressure and with an adhesive. The web 46 includes a pair of opposing elongate edges 50, 52 which are tapered and set into respective flanges 42, 44 with an adhesive. Flanges 42, 44 include respective exterior faces 54, 56, inner faces 58, 60, and end faces 62, 64.

The modified box beam 14 further includes an elongate plate member 66 engaged, such as by pin connectors or adhesive or both, to the inner faces 58, 60 of the flanges 42, 44. A lower edge portion 68 of the plate member 66 lies flush with face 64 of flange 44. An upper edge portion 70 of the plate member 66 extends beyond face 62 of flange 42 so as to expose an elongate face portion 72 of the plate member 66. Face portion 72 and face 62 of the flange 62 form an L-shaped groove 74 for mounting exterior wall partitions such as partitions 22, 24, and 26. Elongate plate member 66 runs parallel to the web 46 and to the flanges 42, 44. A space 76 is preferred between web 46 and plate member 66. Such a space 76 may permit air flow through the beam 14. Plate 66 and web 46 are preferably formed from oriented strand board. Plate member 66 includes an inner face 77.

As shown in FIG. 13, terminating end portions or splices 78 of the I-beam portion 40 are staggered relative to terminating end portions or splices 80 of plate member 66. Such permits the elongate member 66 to span terminating end portions 78 of I-beam portion 40 and also permits I-beam portion 40 to span terminating end portions 80 of elongate plate member 66. It should be noted that posts for the monolithic shell 36, formed by interlocking wall partitions such as 24 and 28, are preferably located over terminating end portions 78 of two I-beam portions 40.

Figure 10:
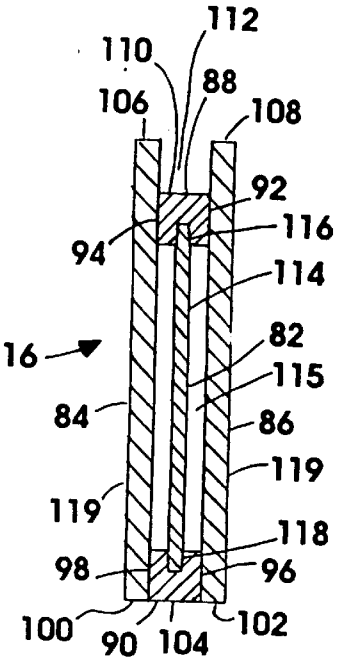
FIG. 10 shows a section view of a modified box beam of the present invention utilized for mounting interior wall partitions.
Figure 11:
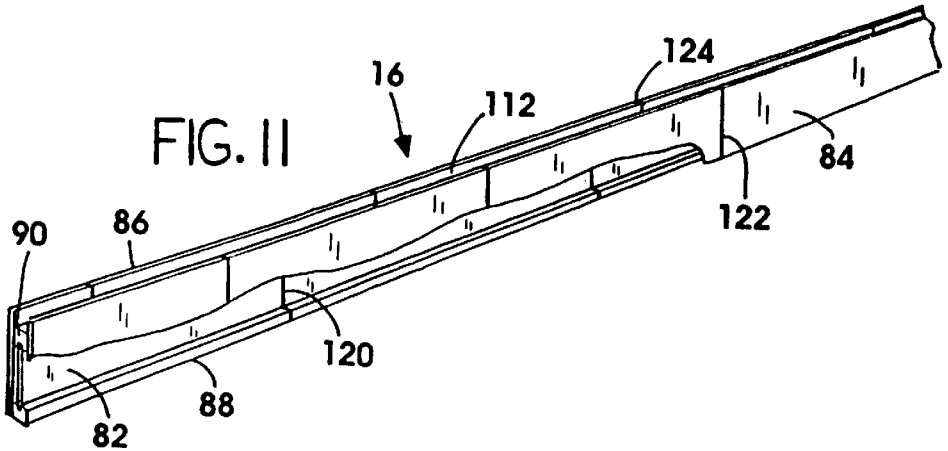
FIG. 11 shows a perspective view of the modified box beam of FIG. 10 and illustrates the spanning and staggering of terminating portions.

The modified box beam 16 is shown in FIGS. 10 and 11. It includes an I-beam portion 82 sandwiched between a pair of outer elongate plate members 84 and 86. I-beam portion 82 is formed like I-beam portion 40 and includes layered parallel extending flanges 88, 90. Flange 88 includes opposing faces 92, 94. Flange 90 includes opposing faces 96, 98. Plate 84 is fixed, such as by pin connectors and adhesive or both, to flange faces 94 and 98 so as to extend parallel to flanges 88 and 90. Plate 86 is fixed, such as by pin connectors and adhesive or both, to flange faces 92 and 96 so as to extend parallel to flanges 88 and 90 and plate member 84. Plate members 84 and 86 include respective edge portions 100 and 102 which lie flush with end face 104 of flange 90. Plate members include edge portion 106, 108 which extend beyond the flange 88 so as to form, with flange face 110, a channel-like receiver 112 for mounting an interior wall partition such as wall partition 28. Plate members 84 and 86 run parallel to a web 114 of I-beam portion 82. A space 115 for a pocket of air is disposed between the web 114 and each of the plate members 84 and 86. Opposite elongate edge portions 116 and 118 of web 114 are tapered and set with adhesive into the layered flanges 88 and 90. Plate members 84 and 86 are formed and mounted to its I-beam portion 82 like plate member 66 is formed and mounted to its I-beam portion 40. Each of the plate members 84 and 86 includes a respective outer face 119.

As shown in FIG. 11, terminating end portions or splices 120 of I-beam or I-joist portion 82 are staggered relative terminating end portions or splices 122 of plate member 84 and terminating end portions or splices 124 of opposing plate member 86. Further, terminating end portions 122 and 124 are staggered relative to each other. Such staggering permits a spanning of the terminating end portions of one component by the other two components. It should be noted that where interior posts are desired, that it is preferred that such interior posts be placed over the terminating end portions 120 of the I-beam portion 82.

Figure 14:
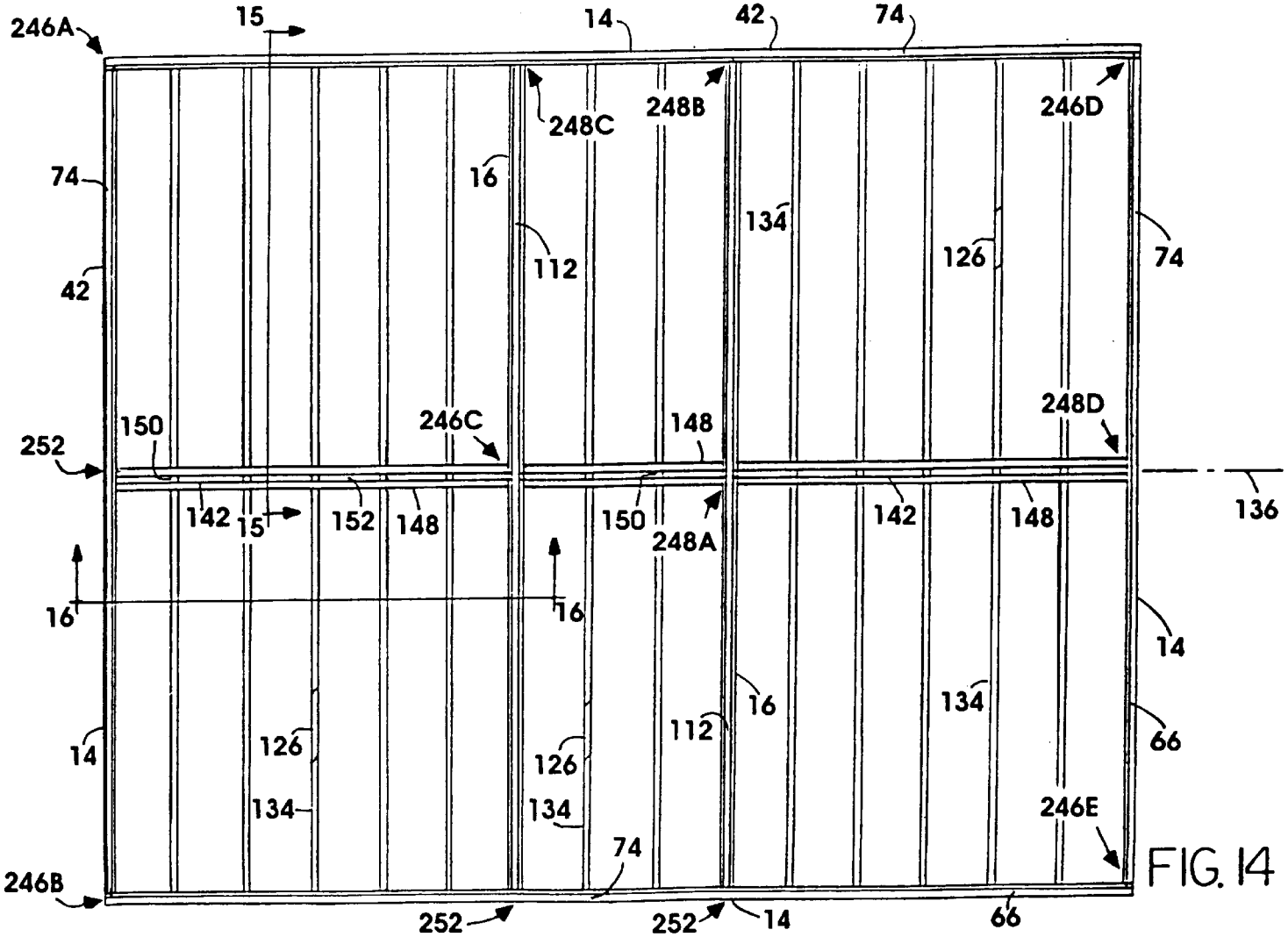
FIG. 14 shows a top view of the base of FIG. 2.
Figure 15:
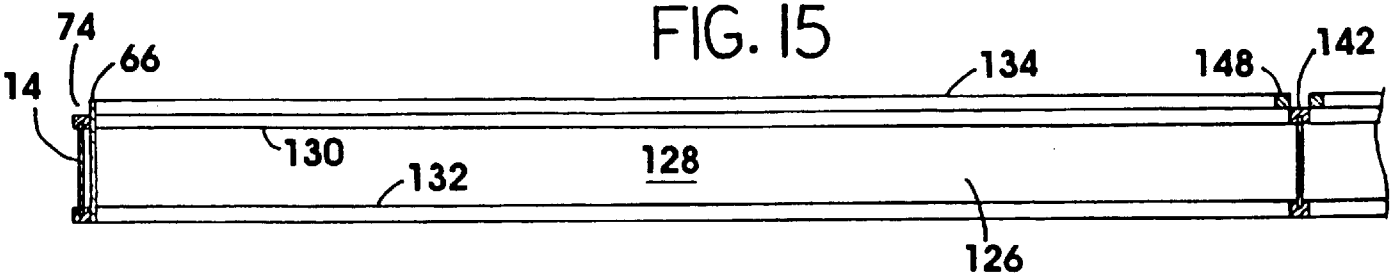
FIG. 15 shows a section view of the base at lines 15—15 of FIG. 14.
Figure 16:
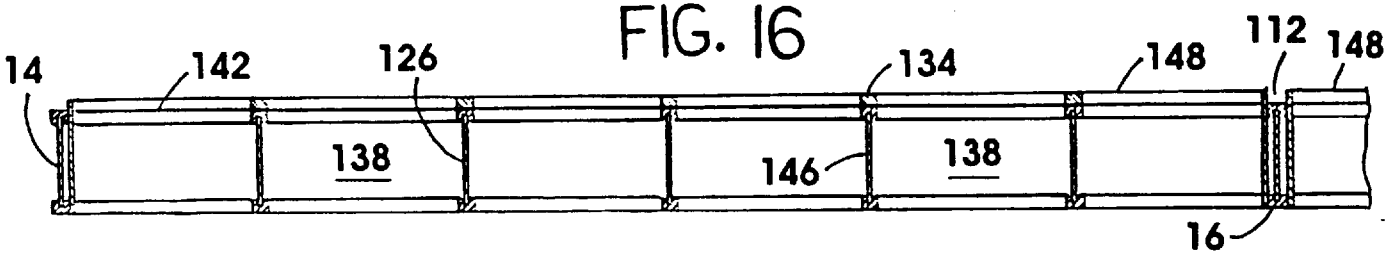
FIG. 16 shows a section view of the base at lines 16—16 of FIG. 14.

As shown in FIGS. 14, 15 and 16, box beam 14 with the L-shaped receiver 74 forms the perimeter of the base 12 for the monolithic shell 36. Laterally extending beams 14 are tucked inside of the longitudinally extending beams 14 and the faces 54 and 56 of flanges 42 and 44 of such lie flush with the terminating end portions of the longitudinally extending beams 14. The laterally and longitudinally extending beams 14 may be joined by pin connectors or adhesive or both. The perimeter extending box beam 14 supports posts, formed by interlocking wall partitions, which in turn supports the roof structure 34. Load from the roof structure 34 is directed downwardly into the wall partitions and posts and further downwardly into the box beams 14 and vice versa.

A pair of lateral box beams 16 having channels 112 traverse between the longitudinally extending beams 14. Posts for the roof structure 34, formed by interior slotted interlocking wall partitions, are preferably located over and supported by the traversing box beams 16 and vice versa. Load from the roof structure 34 is directed downwardly through such posts and onto the box beams 16. Interior wall partitions preferably do not support the roof structure as it is preferable to open up such interior wall partitions. Traversing box beams 16 are engaged, such as by gluing or pin connectors or both, to the longitudinally extending beams 14. It should be noted that the load of the roof structure 34 is thus transmitted directly into the box beams 14 and 16, and the opposite holds true as well.

The longitudinally extending box beams 14 are further supported by a set of I-beams 126 traversing the base 12 therebetween. Each of the I-beams 126 extend between and are engaged to the inner faces 77 of the plate members 66 of such longitudinally extending box beams 14. Such an engagement may be made by adhesive or pin connectors or both. Terminating end portions or splices are preferably minimized in such a base 12. Splices of adjacent parallel extending I-beams 126 are preferably staggered relative to each other. The I-beams 126 are spaced at equidistance apart from each other and from channel box beam 16 at preferably two foot centers. Each of the I-beams 126 is formed like I-beam portions 40 and 82 to include a web 128 of oriented strand board and parallel layered flanges 130 and 132. Each of the I-beams 126 has mounted, at its upper face, via adhesive or pin connectors or both, a two-inch by two-inch support member 134 of preferably dimensional lumber. The I-beam 126 is shown in FIG. 14 by partially cutting away portions of support member 134. Floor panels 18 are fixed onto the support members 134 such as by adhesive or pin connectors or both.

Extending along a longitudinal ridge axis 136 are I-beam portions 138, as shown in FIGS. 16, 21, 22, and 23. Each of the relatively short I-beam portions 138 is formed like I-beam portions 40 and 82 and I-beam 126. Each of the I-beam portions 138 includes a web 140 of oriented strand board and a pair of layered flanges 142 and 144 which extend parallel to each other. Unlike the other I-beam portions 40 and 82 and I-beam 126, I-beam portion 138 includes a tongue 146. The height of the tongue 146 is substantially equal to the distance between the lower face of flange 132 and the upper face of flange 130 of traversing I-beams 126 and the depth of the tongue 146 is substantially equal to the depth of such lower and upper flange faces of traversing I-beams 126 such that tongue 146 interlocks into the flanges 130, 132 and engages web 128 of I-beam 126. The I-beams portions 138 may be engaged, such as by adhesive or pin fasteners or both, to I-beams 126, through their respective webs or flanges or both.

Figure 18:
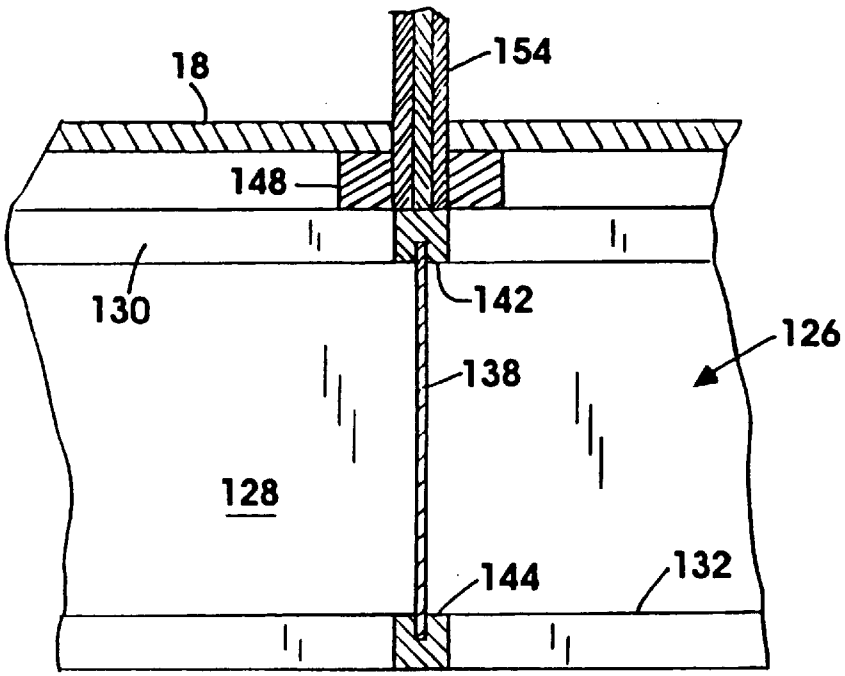
FIG. 18 shows a detail view similar to that of FIG. 17, but includes a three layered wall partition of oriented strand board received in the slot.
Figure 17:
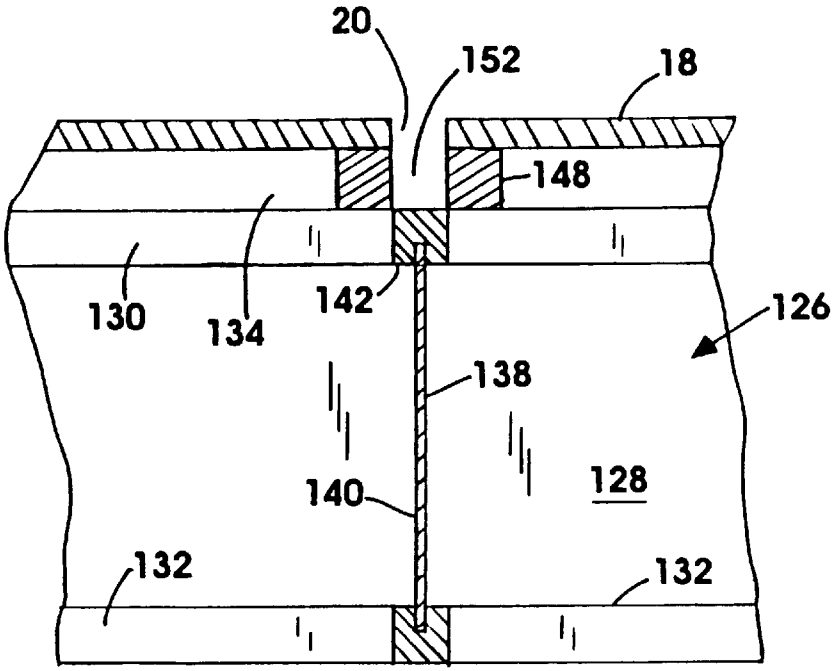
FIG. 17 shows a detail, partially section view of a portion of the base showing how the floor may be slotted to expose a channel formed by an I-beam and a pair of two inch by two inch support members running along one of the flanges of the I-beam.

Running parallel to the ridge axis 136 and adjacent to the flanges 142 are a pair of channel forming support members 148. Members 148 are preferably two-inch by two-inch strips of dimensional lumber. The members 148 are mounted on the traversing I-beams 126, such as by adhesive or pin connectors or both, and are fixed to and between lateral extending box beams 14 and 16 or between lateral extending box beams 16. The inner faces of support members 148 along with the upper face of flange 142 of I-beam portion 138 and portions 150 of the upper face of flange 130 of traversing I-beam 126 form channels 152 for receiving interior wall partitions, such as wall partition 154, as shown in FIG. 18. Channels 152, and channel 112, may be exposed by cutting away slots 20 in the floor panels 18, as shown by FIG. 17.

Lateral extending support members 134 extend between and are engaged to the inner face 77 of the plate member 66 of one longitudinally extending box beam 14 and one of the longitudinally extending support members 148. Such an engagement may be made by adhesive or pin connectors or both.

Figure 19:
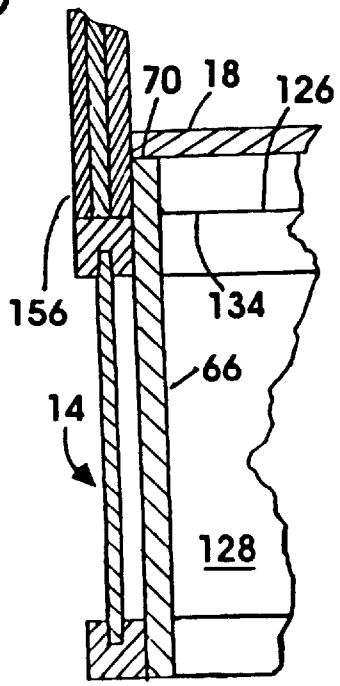
FIG. 19 shows a detail section, partially phantom view of the relationships among the L-grooved box beam for the perimeter of the base, an exterior wall partition, the floor, and a two inch by two inch support member.
Figure 21:
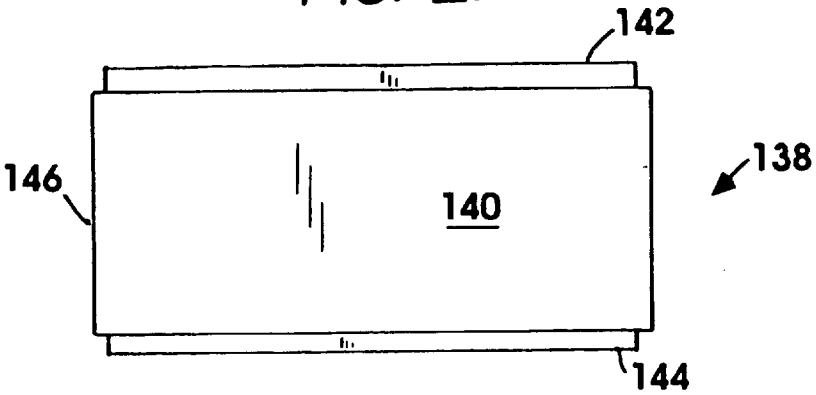
FIG. 21 shows an elevation view of a relatively short I-beam portion for interlocking between relatively long I-beams.
Figure 22:
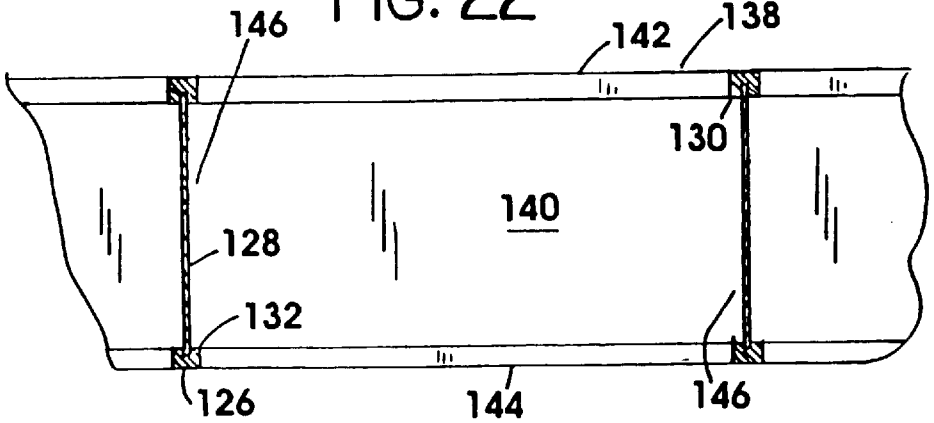
FIG. 22 shows an elevation, partially section view of the I-beam of FIG. 21 interlocking between elongate I-beams.
Figure 23:
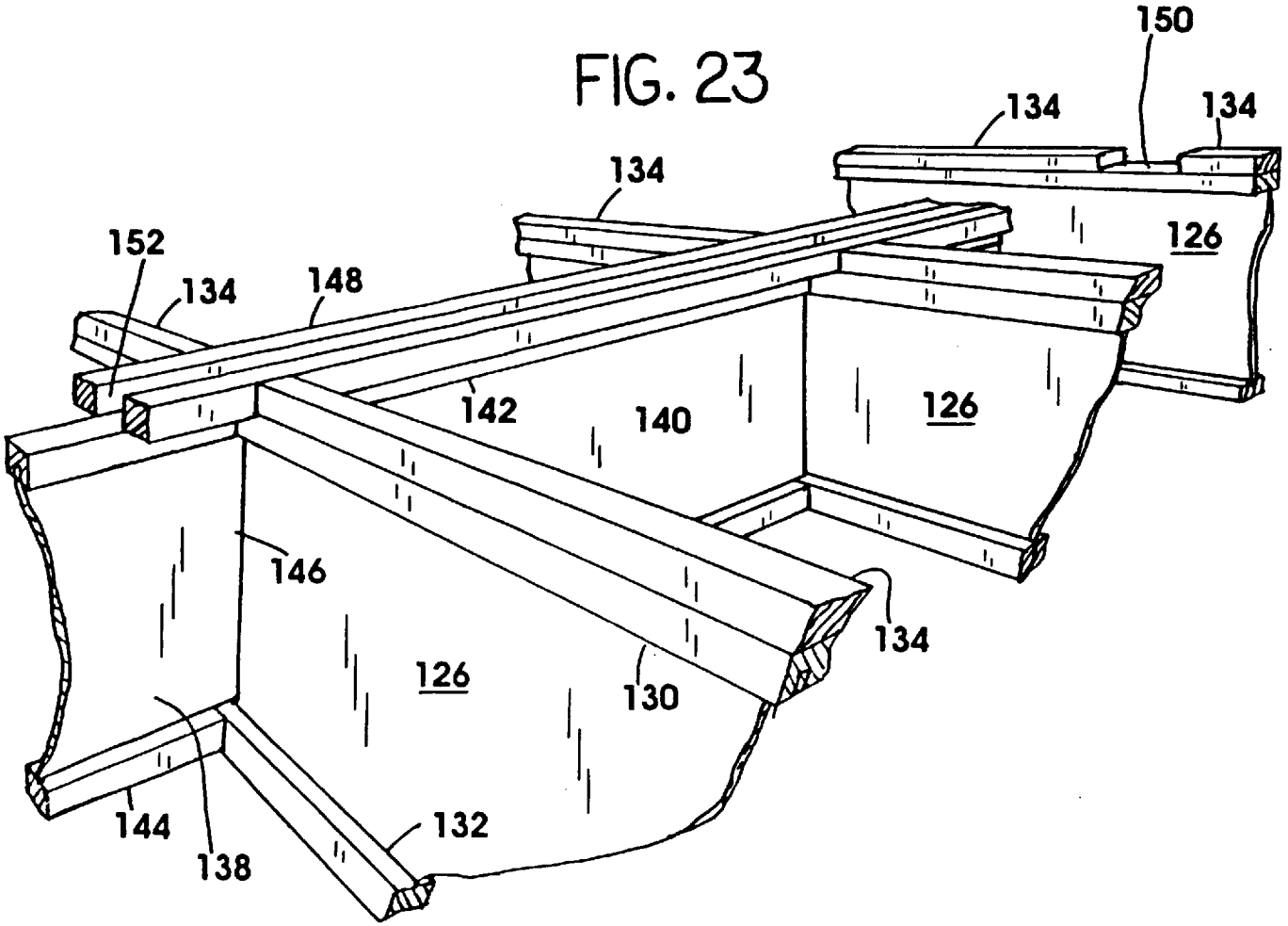
FIG. 23 shows a perspective, detail view of a portion of the base and illustrates the wall partition receiving channels formed by the upper flanges of the relatively short I-beam, flange portions of the crossing elongate I-beam, and a pair of two inch by two inch strips.

FIG. 19 shows in detail the floor panel 18 being mounted on the upper edge portion 70 of the inner plate member 66 of box beam 14. FIG. 19 further shows an exterior wall partition 156 supported by a longitudinally extending box beam 14.

Figure 20:
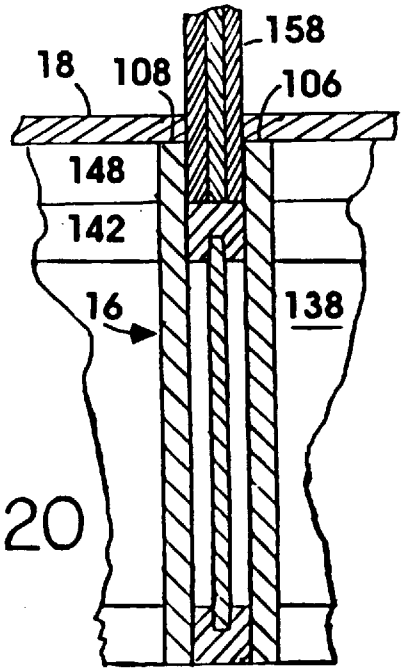
FIG. 20 shows a detail section view of the relationships among the channeled box beam, interior wall partition, the floor, and a two inch by two inch support member.

FIG. 20 shows the floor panel 18 mounted to upper edge portions 106 and 108 of channel box beam 16. FIG. 20 also shows an interior wall partition 158 received by channel 112 and supported by box beam 16.

It should be noted that all of the components of the base 12 may be joined together with adhesive and pin connectors or both. As the base 12 is prefabricated to result in a true base, the base 12 serves as a building jig for the remainder of the monolithic shell 36. It should be noted that all of the flanges of all of the I-beams or I-beam portions lie in two respective planes, and that all joints or connections are made at right angles. Base 12 is monolithic.

Figure 24:
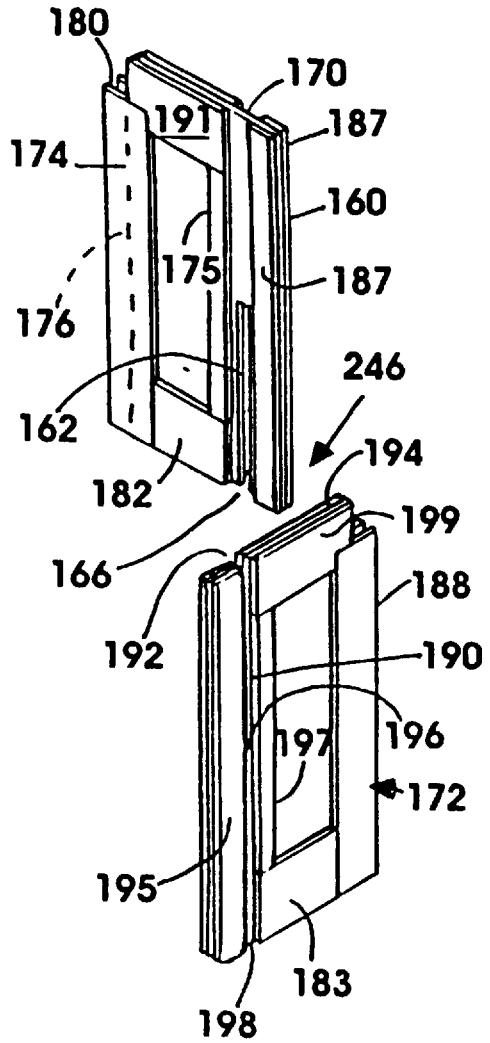
FIG. 24 shows an exploded perspective view of two interlocking, slotted wall partitions for forming a post, with each of the wall partitions having a female receptor on one of its side edge portions, with each of the wall partitions having upper and lower reference locators or scabs, and with fins and furring strips on the partitions.
Figure 25:
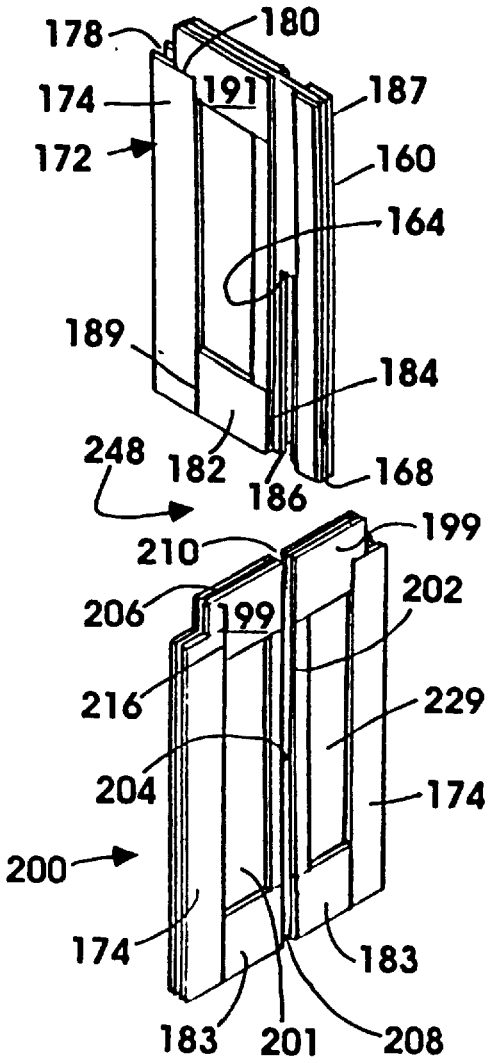
FIG. 25 shows an exploded perspective view of two interlocking, slotted wall partitions for forming a post, with one of the wall partitions having a female receptor on both of its side edge portions and a pair of upper and a pair of lower reference locators, and with fins and furring strips on such partition.
Figure 26:
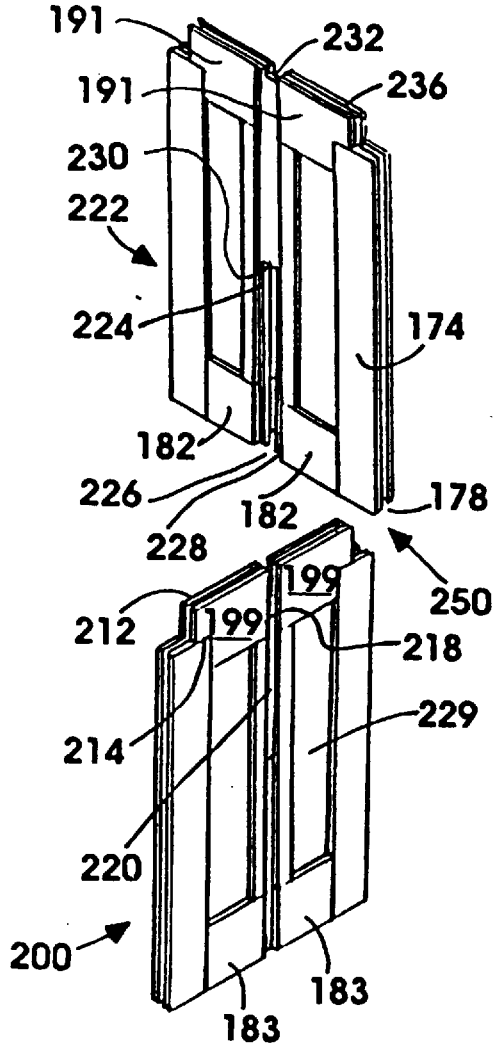
FIG. 26 shows an exploded perspective view of two interlocking, slotted wall partitions for forming a post, with both of the wall partitions having a female receptor on both of its side edge portions, with both of the wall partitions having a pair of upper and a pair of lower reference locators, and with fins and furring strips on the partitions.

FIGS. 24, 25, and 26 illustrate post forming, interlocking wall partitions. FIGS. 24 and 25 show a wall partition 160 with a slot 162 having a seat 164 and an opening 166 formed at a bottom edge 168. Seat 164 is formed midway between bottom edge 168 and an upper edge 170. Wall partition 160 further includes a female receptor 172 formed of a pair of panel strips or furring strips 174 engaged on both faces of the wall partition 160. A second pair of furring strips 175 is disposed parallel to furring strips 174 but adjacent to the slot 162. Vertical edges of the furring strip 175 which are adjacent the slot 162 terminate one panel width short of the edge of such slot to engage the fin or furring strips of its interlocking partition.

The panel strips 174 extend beyond a vertically extending edge 176 to form a receiver or groove or channel 178. It should be further noted that the panel strips 174 of the female receptor 172 include horizontally extending load transfer edges 180.

Wall partition 160 further includes a pair of lower position or reference locators 182, each of which have a vertically extending edge 184 terminating short of slot forming edge 186 for locating the wall partition 160 relative to another wall partition 188. Edge 184 terminates short of edge 186 to permit a three panel thick fin or furring strip to be received between it and a fin or fin strip or clamp 187. Fins 187 extend vertically and have outer edges parallel with an outer edge of the main panel of partition 160. An opposite vertically extending edge 189 of each of the locators 182 engages a respective vertical edge of one of the panel strips 174. Each of the panel strips 174 is disposed in a common plane with its respective position locator 182. Wall partition further includes an upper reference locator 191 with vertical edges disposed in line with lower reference locator or scab 182.

Wall partition 188 is similar to wall partition 160 except that wall partition 188 includes a slot 190 with a slot opening 192 at an upper edge 194, except that the upper position locators or scabs 199 have their vertical edges, which are adjacent to the slot forming side edge portion, flush with the slot forming edge, except that the lower position locators or scabs 183 have their similarly situated vertical edges in line with the vertical edges of the upper scabs 199, except that the fins 195 have their inner edges lying flush or in line with the slot forming edges of the main panel of partition 188, and except that the furring strips 197 have their outer edges flush with the slot forming edges of the main panel.

A slot seat 196 is formed midway between upper edge 194 and a lower edge 198. The scabs 183, 199 are disposed on either side of the partition 188 and a female receptor 172. Furring strip 197 is also disposed on each of the sides of the main panel. Wall partitions 188 and 160 interlock to each other by engaging the seats 196 and 164, by engaging the slot forming edges of each of the partitions with the faces of the other partition, by the engagement of the opposing edges of the fin 195 and furring strip 197 with the face of the main panel of partition 160, and by engagement of the opposing edges of furring strip 175 and the opposing edges of fin 187 with the faces of fin 195 and furring strip 197. The respective edges of the upper scabs 199, 191, and lower scabs 182, 183 engage likewise.

FIG. 24 shows one type of wall partition, partition 160, interlocking with a similar type of wall partition, partition 188, to form a post. FIG. 25 shows such a wall partition, partition 160, interlocking with another type of wall partition, partition 200. The main panel 201 of partition 200 is formed from substantially a whole piece of eight feet by four feet of oriented strand board, which is the preferred size as oriented strand board is engineered at and for such a size. Partition 200 includes a slot 202 with a seat 204 midway between upper and lower edges 206, 208, and a slot opening 210 in the upper edge.

Partition 200 further includes a set of four lower position locators 183, a set of four upper position locators 199, and a set of four furring strips 197 (or eight furring strips if the female receptor panel 174 is included). One side of the upper position locators 199 includes cut out portions formed by a vertical edge 214 and a horizontal edge 216 to transfer load forces onto panel strips 174. Opposite sides of the locators 199 include a vertical edge 218 to lie flush with an edge 220 forming slot 202 to contact and engage a face of the interlocking partition. Each of the lower locators 183 also confront and engage one of the faces of the interlocking partition. Further, each of the vertical edges of the furring strips 197 which are adjacent to the slot 210 confront and engage one of the faces of the main panel of the interlocking partition 160. The upper and lower locators 199 and 183 and female receptor panels 174 lie in one of two common planes. Partitions 160 and 200 interlock in a similar manner to the interlocking of partitions 160 and 188.

Partition 200 further includes a pair of female receptors 172 instead of a single one like partitions 160 and 188. Such female receptors lie parallel to each other.

Another type of a slotted, interlocking wall partition, partition 222, is shown in FIG. 26. Such a partition is similar to partition 200 except partition 222 includes a slot 224 forming a slot opening 226 at a lower edge 228, and except that the furring strip 175, fin strip 187, and scabs 182 and 191 have their inner vertical edges terminating short of the edges forming slot 226 to receive therebetween the three panel thickness of the upper scab 199-main panel 229-upper scab 199, or furring strip 197-main panel 229-furring strip 197, or lower scab 183-main panel 229-lower scab 183. Partition 222 includes a seat 230 formed midway between the lower edge 228 and an upper edge 232.

Further, it should be noted that partition 222 differs from partition 200 in that the scab header or position locator 191 may extend beyond the upper edge 232 of the main panel to form an elongate female receiver 236. Such a header or scab 191 with such a receiver 236 may engage partitions extending from the header or scab 191 to the underside of the roof structure 34.

Figure 27:
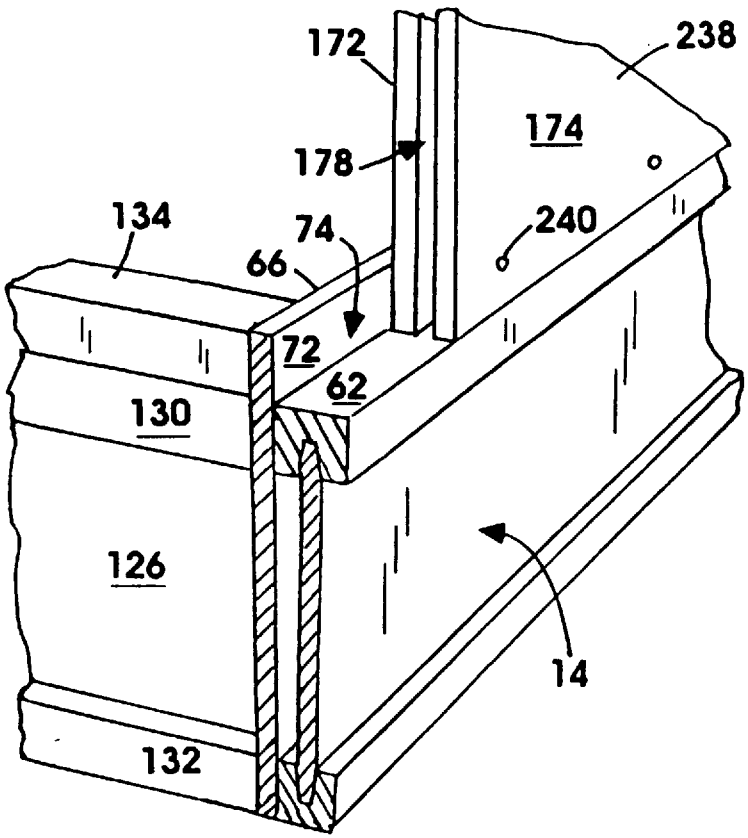
FIG. 27 shows a perspective view of the relationships among the exterior, perimeter extending L-grooved modified box beam, an exterior wall partition, and a two inch by two inch support member upon which floor panels are mounted.

FIG. 27 illustrates how an exterior wall partition 238 engages the L-shaped receiver 74 of the box beam 14 and illustrates the female receptor 172 in detail The lower edges of the panel strips 174, reference locators 182, and the main panel of the partition 238 itself rides and is slideable against face 62 until the partition 238 is engaged by adhesive or pin connectors 240 to elongate plate 66.

Figure 28:
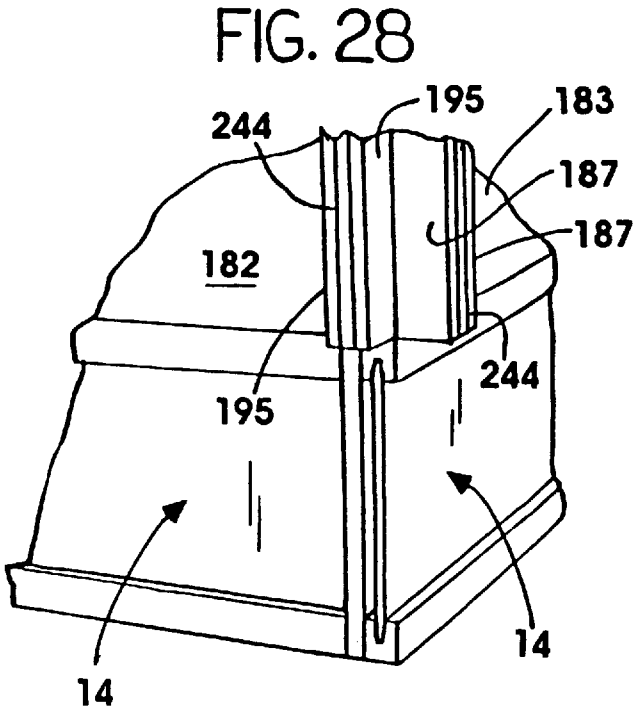
FIG. 28 shows a perspective view of the corner fit between two of the L-grooved modified box beams and also illustrates clamps for the interlocking wall partitions.

FIG. 28 shows in detail a corner location where a lateral extending beam 14 meets a longitudinally extending beam 14. FIG. 28 further shows the addition of the strips or fins or clamps 187, 195 for further locking the partitions, such as partitions 160 and 188 to each other. Such strips 187, 195 are affixed to the faces of the partitions 160 and 188 entirely along the outer vertical edges 244 of such partitions. The width of the strips 195 are defined by the width between the slot and its respective vertical edge 244; the respective partitions having strips 195 run parallel to the ridge axis. The width of the strips 187 (whose partitions run perpendicular to the ridge axis) is one main panel thickness less to receive the fin or furring strip or upper or lower scab of the interlocking panel having fin strips 195. As to such clamps or strips 187, 195, the Leslie U.S. Pat. No. 5,351,453 is hereby incorporated by reference in its entirety.

FIGS. 24, 25, and 26 illustrate the formation of respective posts 246, 248, and 250. It should be noted that such partitions may be turned around or mirrored. Further, slots may open at upper or lower partition edges.

Figure 29:
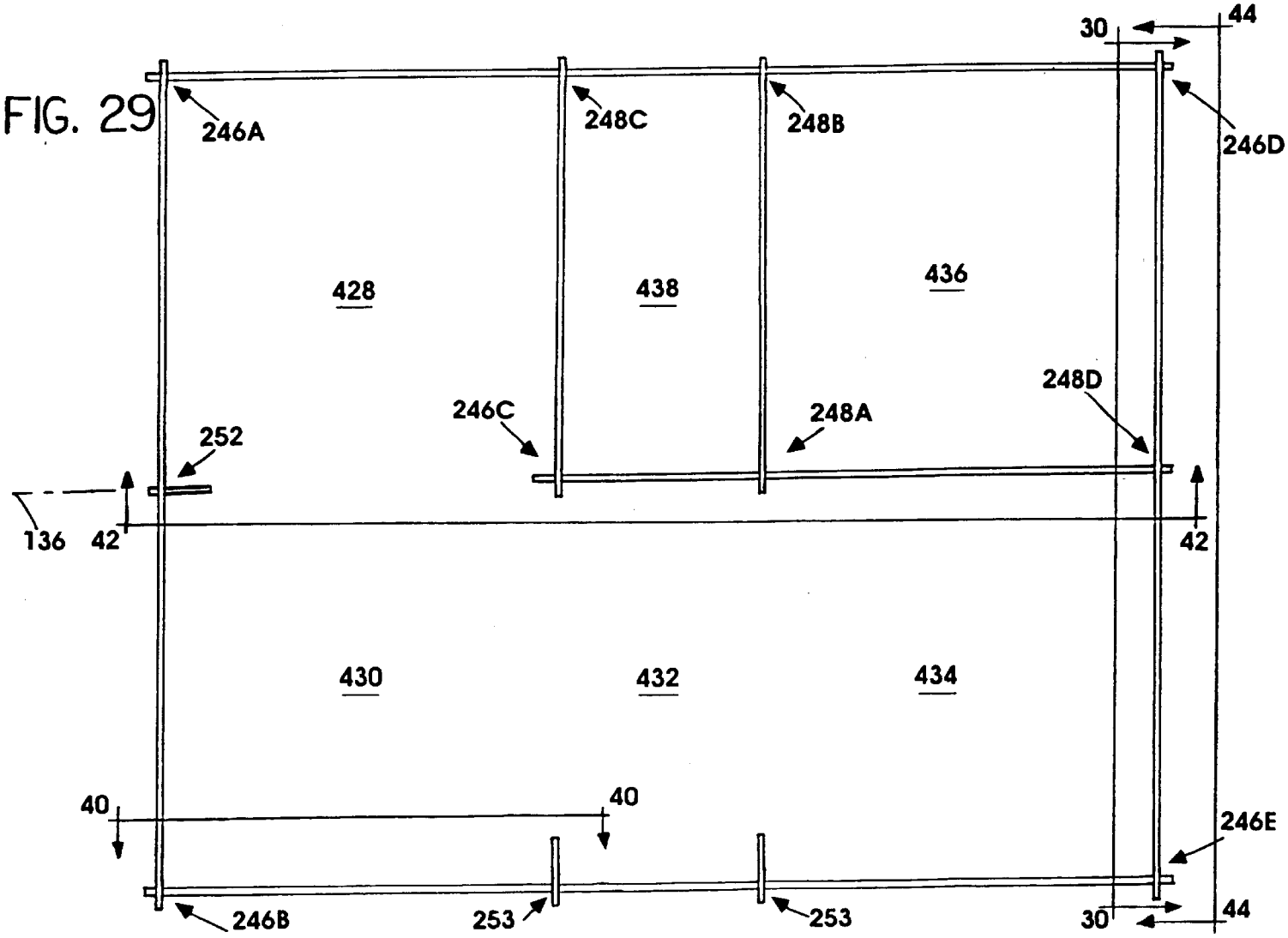
FIG. 29 shows a top view of one type of wall partition arrangement for the monolithic shelter of the present invention.

FIG. 29 illustrates some preferred locations for the posts 246, 248, and 250. Post 246 or similar posts may be formed at post locations 246A, 246B, 246C, 246D, and 246E. Post 248 or similar posts may be formed at post locations 248A, 248B, 248C, and 248D. Posts 250 may be located at interior positions in the shell 36.

By relating FIGS. 14 and 29, it can be seen that posts 248A and 246C utilize the channels or receivers 112 of the box beams 14 and the channels or receivers 152 formed by support members 148 and I-beam flange 142 and flange portions 150. Receivers 112 and 152 communicate with each other. Posts 248B and 248C utilize receivers 112 and 74 of the box beam 14, which also communicate with each other. Corner posts 246A, 246B, 246D, and 246E are mounted in receivers 112 of the lateral and longitudinally extending box beams 14. Such lateral and longitudinally extending receivers 112 communicate with each other. Post 248D is mounted in the ridge extending receiver 152 and laterally extending receiver 72 of box beam 14; such receivers 152 and 72 also communicate with each other. It should be noted that communication between the receivers can be made by notching out portions in the elongate plate members 66, 106, and 108 of the box beams 14 and 16.

It should be noted that partition 28, seen in perspective in FIG. 5, may form a post 252 with other partitions, such as partitions 160, 222. It should be noted that partition 160 is identical to partitions 22 and 26. It should further be noted that partition 24 is identical to partition 222 except that partition 24 lacks the slightly larger header and its attendant receiver 236. Partition 28 may have an elongate female receptor 172 extending along its inner vertical edge. Posts 253 have a partition similar to partitions 28 except with a slot opening at its bottom edge. It should be noted that it is preferred that partition 28 and its similar partition in post formations 253 have a depth or distance between their vertical edges of at least one foot.

In FIG. 29, it should be noted that it is preferred that the laterally extending slotted wall partitions have slot openings in their lower edges. The longitudinally extending partitions, extending parallel to the ridge axis 136 have slot openings in their upper edges. In other words, the longitudinally extending partitions seat the laterally extending partitions.

Figure 30:
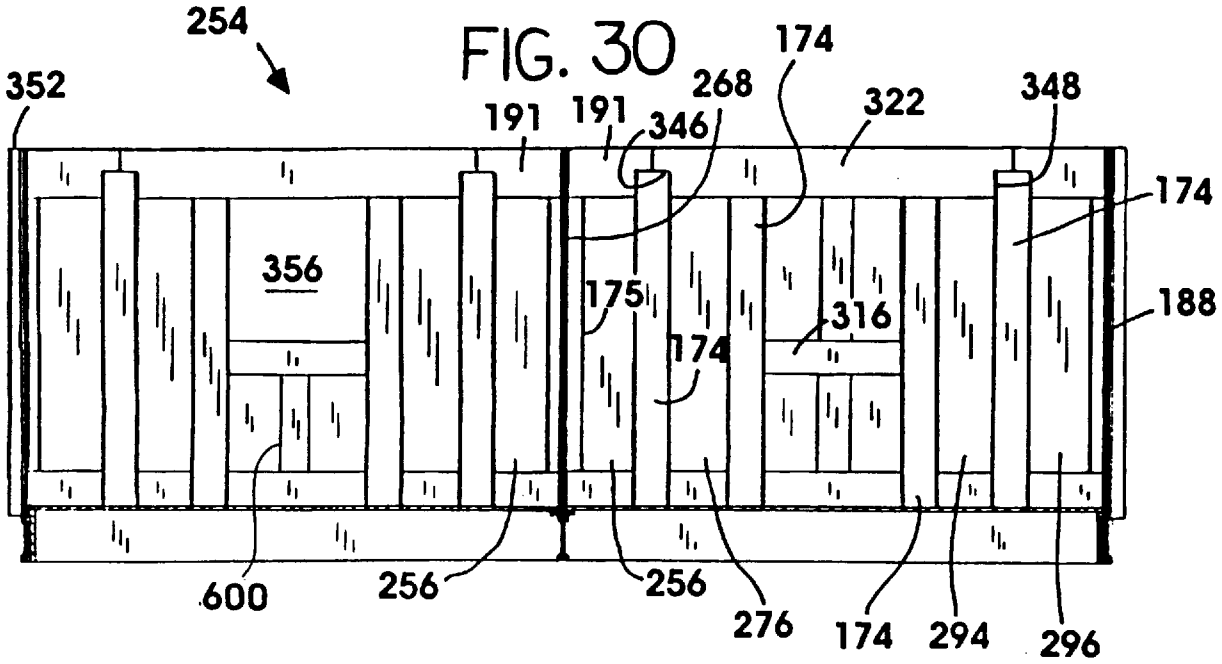
FIG. 30 shows an end, partially section view of one sidewall of the monolithic shelter at lines 30—30 of FIG. 29.
Figure 31:
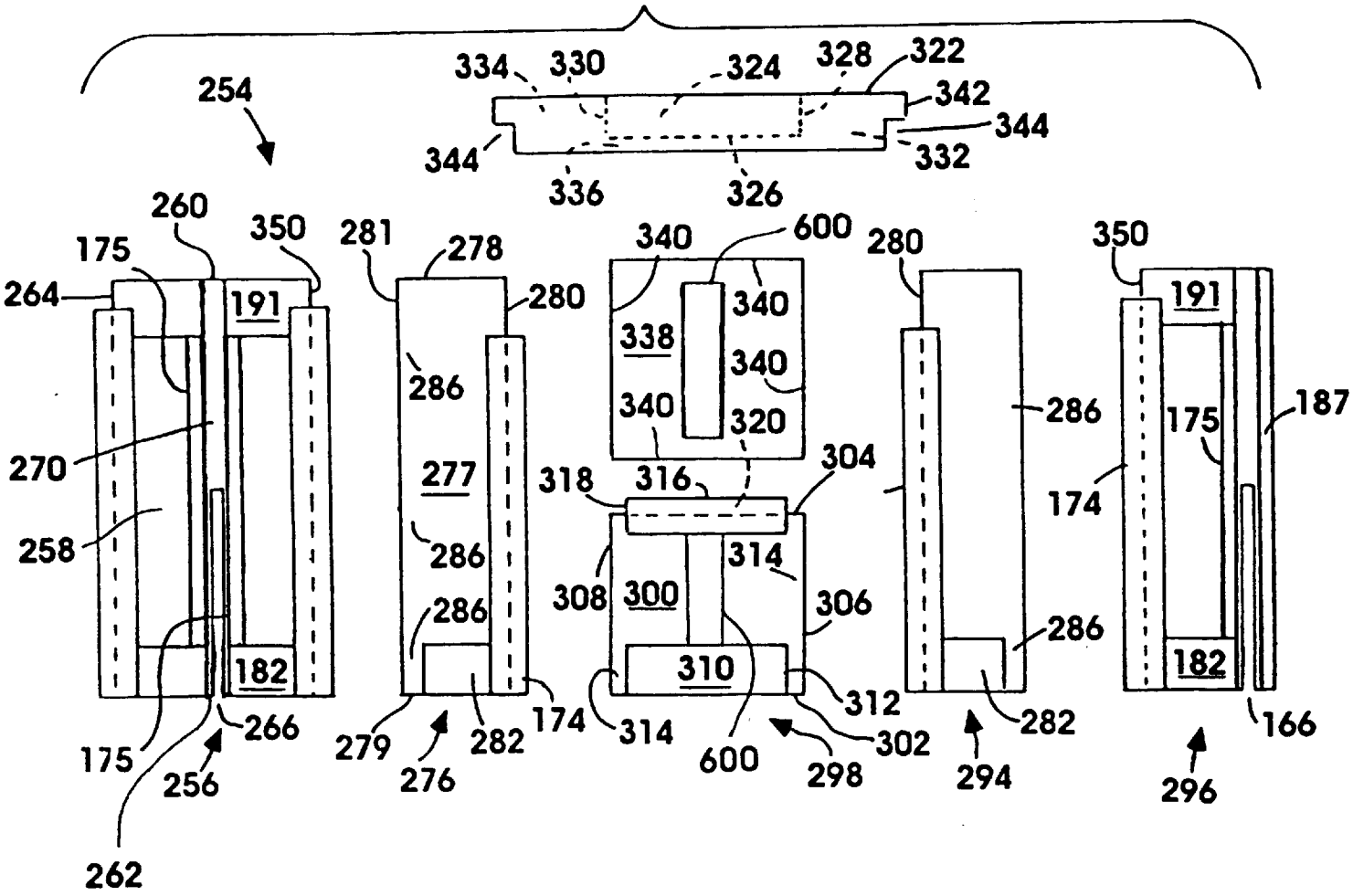
FIG. 31 shows an exploded view of a portion of the sidewall of FIG. 30.
Figure 32:
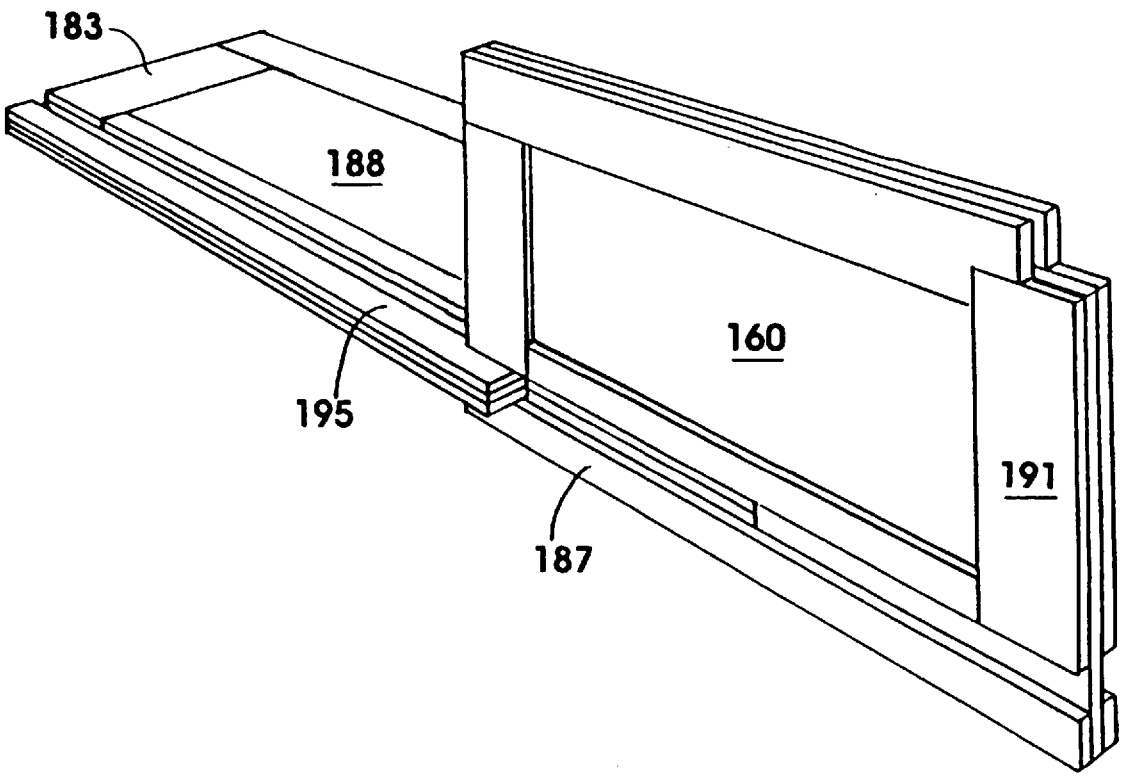
FIG. 32 shows a perspective view of the post forming partitions of FIG. 24 to indicate that the slots of each are interconnected when the partitions are disposed at ground level and, after being interlocked, are raised upright onto the base of FIGS. 2, 3, or 4.
Figures 33A, 33B, 33C, 33D, 33E, 34A, 34B, 34C, 34D, 34E, 35A, 35B, 35C, 35D, 35E, 36A, 36B, 36C, 36D, 36E, 37A, 37B, 37C, 37D, 37E, 38A, 38B, 38C, 38D, 38E:
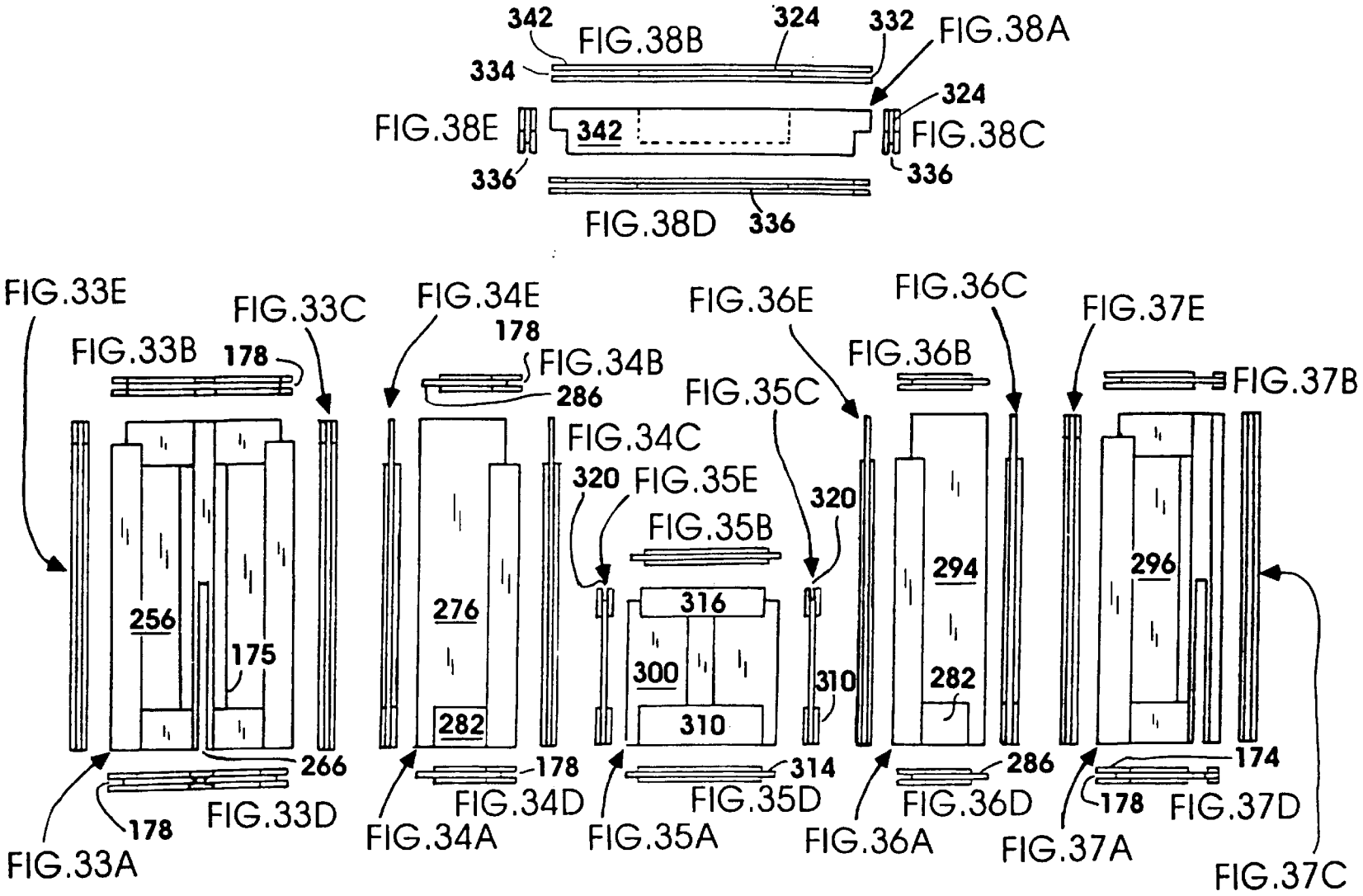
Figure 44:
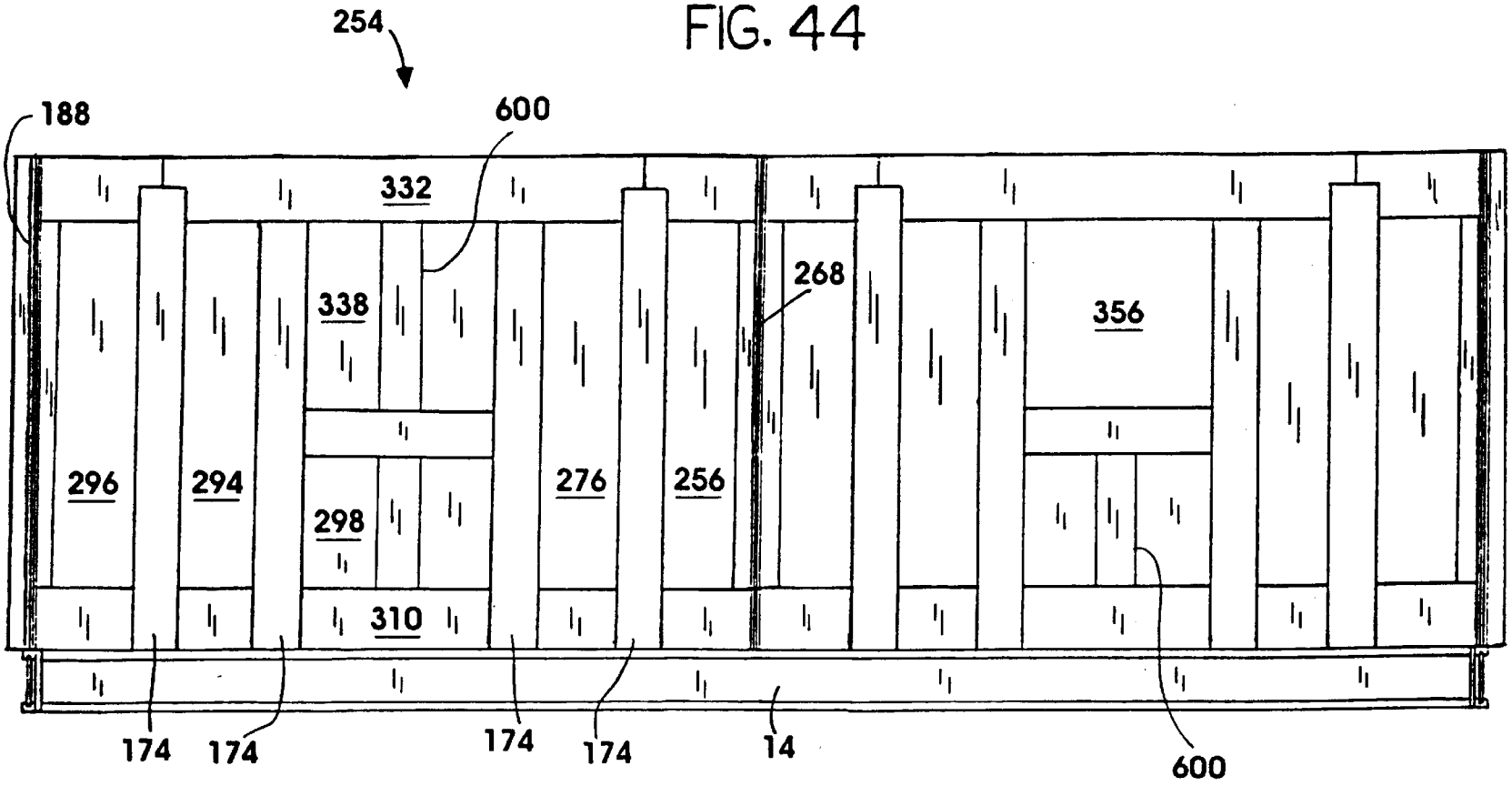
FIG. 44 shows an elevation view of the exterior of the wall of FIG. 30.

FIG. 30 shows an assembled sidewall 254. FIG. 31 shows an exploded view of a portion of the sidewall 254, prior to assembly. FIGS. 33–38 show side, top, end, bottom, and opposite end views of each of the wall components of FIG. 31. FIG. 44 shows the other, exterior side of the assembled sidewall 254 to show that each face of each wall partition is a mirror image of its other face.

Sidewall 254 includes a slotted, interlocking wall partition 256. The wall partition 256 includes a base or main, generally rectangular panel 258 formed from a piece of oriented strand board eight feet by four feet. The panel 258 includes an upper edge 260, a lower edge 262, and a pair of vertically extending edges 264 for abutting male panel portions. Affixed to opposing faces of the panel 258 and extending beyond the vertical edges 264 are the set of two female receptors 174, with channels 178. A set of four lower reference locators 182 participate in the formation of a slot 266. Slot 266 interlocks with partition 268, seen in FIG. 30. Lower reference locators 182 abut female receptors 172. A set of four upper reference locators 191 lack a receiver along their upper edges. Reference locators 191 which are disposed on the same face of panel 258 form a channel 270 for reception of partition 268. Such a reception is further facilitated by panel or furring strips 175 mounted between lower and upper reference locators 182 and 191. Panel strips 175 terminate short of the edges forming slot 266 to permit the three panel thickness reception of partition 268.

Sidewall 254 further includes partition 276 which includes a main panel 277 having upper and lower vertical edges 278, 279, and vertical edges 280, 281. Partition 276 further includes a pair of panels 174 slightly shorter than the panels 174 on partition 256, a lower scab 282 for abutting between panels 174 of adjacent partitions, and a male panel portion 286 running vertically along and including edge 281. Male panel portion 286 mates with female receptor 172 until edge 281 engages edge 264. Such an engagement may be reinforced with adhesive or pin connectors or both.

Sidewall 254 further includes partition 294 which is identical to partition 276.

Sidewall 254 further includes partition 296 which is identical to partition 160. Partition 296 interlocks with partition 188.

Sidewall 254 further includes a partition 298 having a main panel 300 with a lower edge 302, an upper edge 304, and a pair of vertical edges 306 and 308. The partition 298 further includes a set of two reference locators or scabs 310 with vertical edges 312 for abutting female receptors 172. Partition 298 further includes a pair of male panel portions 314 for being received in the female receptors 172 of adjacent partitions 276 and 294. Partition 298 further includes an upper reference locator 316 with vertical edges 318 for abutting female receptors 172. Reference locator 316 further extends beyond edge 304 for forming a receiver or channel or groove 320.

Sidewall 254 further includes a header 322 having a generally rectangular inner panel 324 with a lower edge 326, and a pair of side or vertical edges 328, 330. Header 322 further includes a pair of end female receivers 332 and 334 and an elongate lower receiver 336. End receiver 332 receives a portion of the main panel of partition 294 and end receiver 334 receives a portion of the main panel of partition 276. Vertical edge 330 abuts vertical edge 280 of partition 276 and edge 328 abuts edge 280 of partition 294. Lower edge 326 abuts a partition 338.

Partition 338 is included in the sidewall 254 and is a flat panel having male panel portions 340 at its four side edge portions. Male panel portions 340 are received in the female receivers 178 of partition 276 and 294, in the receiver 336 of header 322, and in the receiver 320 of partition 298.

Header 322 further includes a set of two outer main panel portions 342 laminated to the inner panel 324 to form the receivers 332, 334, and 336. At its end portions, panel portions 342 include cut out portions 344 formed by horizontal edges 346 and vertical edges 348. Edges 346 abut the upper edges of female receptor panels 172 of partitions 256 and 296. Vertical edges 348 abut vertical edges 350 of upper reference locators 191 of partitions 256 and 296.

It can be appreciated that each of the partitions 256, 276, 298, 294, 296, and 338 is captured on all of its four sides by either upper reference locators, lower reference locators, female receptor panels, or the header 322. Further, as to partition 256, it can be seen that if the main panel 258 is considered as two panel portions, each panel portion is still captured on all four sides by virtue of the contribution of the furring strip 175.

It can be further appreciated that load is transmitted at two foot centers at either the posts formed by interlocking partitions 256 and 296 or through the female receptor panels 174, or strips 272. These two foot centers, when such a sidewall 254 is disposed on one of the longitudinal sides of the shell 36, are in line with the I-beams 126.

It can further be appreciated that I-beam rafters 354 are disposed at such two foot centers. Load from the rafters 354 is transmitted into the female panel receptors 174 and vice versa via the monolithic connection illustrated in FIGS. 53–58.

It can thus be appreciated that each pair of female receptor panels 174, in combination with its respective main panel and the male member receiver therein, acts as a post of relatively great width (preferably nine inches) and a relatively great depth (three layers of oriented strand board).

It can further be appreciated that the entire sidewall 254 is formed of oriented strand board. Air permeates little, if at all, through the main resin permeated panels of each partition. Further, the female receptor and male panel portion connections are sealed to render it difficult for air to move between the interior and exterior of the sidewall 254.

It can further be appreciated that load is distributed in a number of different ways through the vertical, lateral, and longitudinal axes of the sidewall 254. Each partition of the sidewall 254 distributes load in all three directions. Further, some individual components of the partitions distribute load in all three directions, including the main panel portion and its male member portion, the female receptor panels, and the header 322. The upper reference locators distribute load in two directions.

It can be appreciated that all of the components of each individual partition (or header) of sidewall assembly 254 can be engaged to the other components it contacts with adhesive or pin connectors or both. Further, all of the contacting components between adjacent partitions (or header) can be engaged to each other with adhesive or pin connectors or both.

It can be appreciated that the lower edge portions of the partitions of sidewall assembly 254 (except partition 338) are engaged by the L-shaped receiver 74 of the box beam 14. Accordingly, such partitions can be slid in place relative to one another.

It can be appreciated that in FIGS. 30 and 44, reference numeral 356 designates a window opening. Such an opening is formed by excluding partition 338 from the sidewall assembly 356.

A header 358 for spanning an opening 359 of a relatively great width is shown in FIGS. 39A, 39B, and 39C. The header 358 distributes load along the vertical, longitudinal, and horizontal axis relative to posts or female receptor panels 174. The header 358 includes an inner rectangular panel 360 having a lower edge 362, and upper edge 364, and side edges 366. The header 358 further includes a pair of outer panels 368 having end cut out portions 370 to expose a portion of the inner panel 360 so as to form tongues or male panel portions 372. Outer panels 368 extend beyond lower edge 362 to form an elongate female receiver 374. Outer panels 368 further include horizontal edges 376, 377 and vertical edges 378 to form the cut out portions 370. It should be noted that load forces along the vertical axis are distributed by horizontal edges 376 of the header 358 and upper edges 380 of female receptor panels 174. Load forces along the horizontal axis are distributed by horizontal edges 376, 377, and 366 of the header 358 and vertical edges 382 of the female receptor panels 174, vertical edges 384 of upper position locators 386, and vertical edges 387 of main panels 388 and 390. Load forces along the lateral axis are distributed by the tongue or male panel portion 372 and the female receptor panels 174.

Figures 41A, 41B:
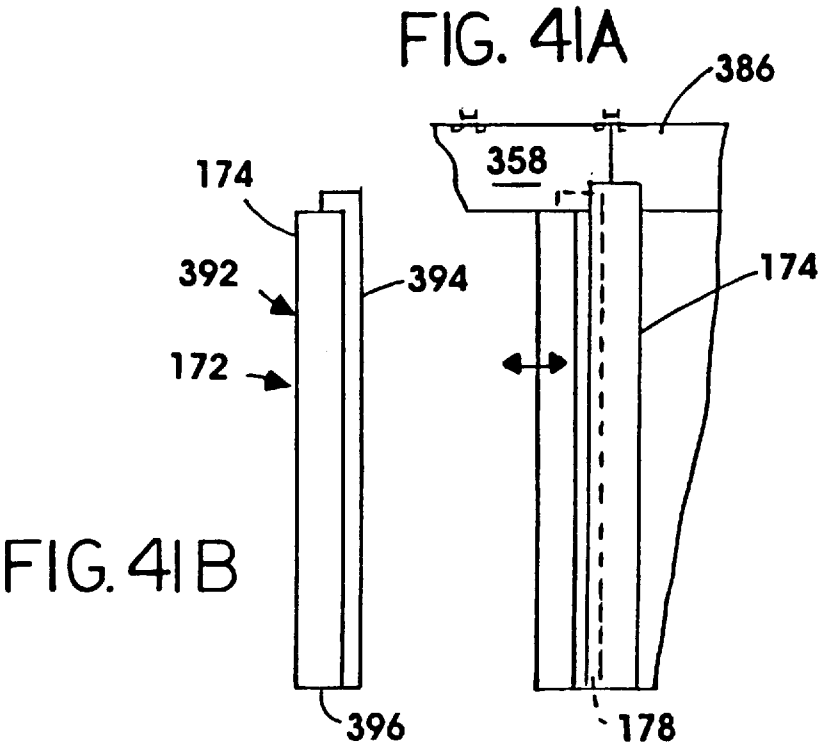
FIG. 41A shows a trimming partition having a female receptor for customizing the width of the opening of FIG. 40.
FIG. 41B shows an isolated view of the trimming partition of FIG. 41A

FIG. 41A shows a trim piece or portion 392 having the female receptor 172 and its two female receptor panels 174. Trim piece 392 further includes a male panel member 394 extending in the longitudinal and vertical directions so as to engage both the elongate female receiver 178 between the panels 174 and the female receiver 374 in the header 358. Trim piece 392 maybe used to custom fit an article such as a sliding glass door in the shell 36. It should be noted that a bottom edge 396 is engaged in the L-shaped receiver 74 of the box beam 14.

Figures 42, 43A, 43B:
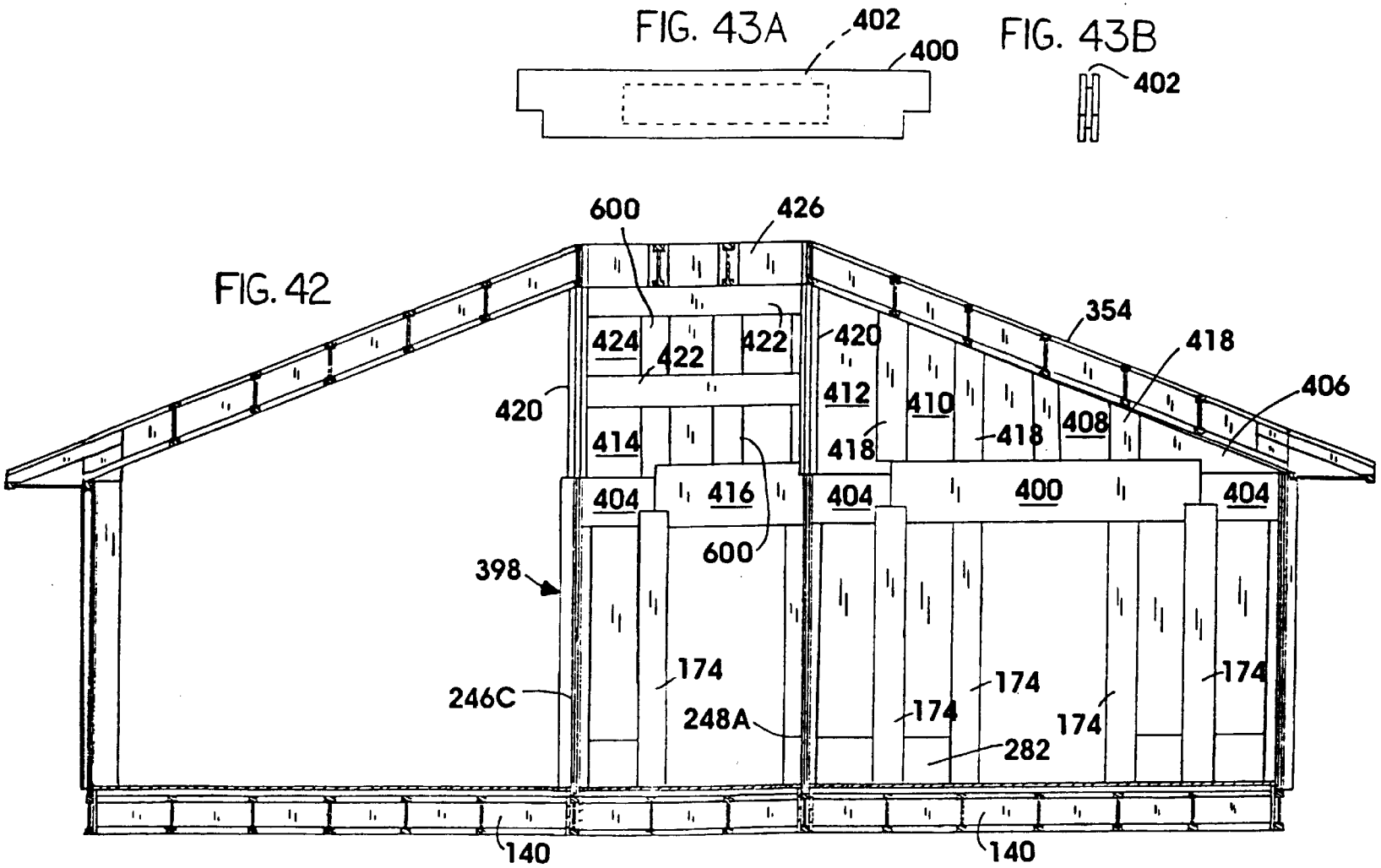
FIG. 42 shows a partially section view of the ridge wall of the present monolithic shelter at lines 42—42 of FIG. 29 and also illustrates a portion of the roof structure.
FIG. 43A shows a side view of the header for the wall of FIG. 42.
FIG. 43B shows an end view of the header of FIG. 43A

An interior wall assembly 398 is shown in FIG. 42 and extends along the ridge axis 136. Such a wall assembly is generally similar to exterior wall assembly 254 with the following exceptions. Channel receivers 112 and 152 are used instead of L-shaped receiver 74. Further, lower position locators may not be used. Also, a header 400 may be identical to header 322 except that the outer panels 342 may be extended upwardly to form a female receiver 402.

It can be appreciated that interior wall assembly 398 includes female receptor panels or posts 174 at two foot centers, upper position locators 404 with upper elongate female receivers for receiving panels 406, 408, 410, 412, and 414. A header 416 includes an upper elongate female receiver for receiving main panel 414.

It can further be appreciated that posts 174 effectively extend upwardly to a second story to support the I-beam rafters 354 of the roof structure 34. Such is illustrated by the second story vertically extending female receptor panels 418 in line with the first story panels 174. Two sets of three two inch by six inch support members 420 of dimensional lumber are mounted on post formations 246C and 248A. Extending between the members 420 are second story horizontally extending female receptor panels 422, which are similar to receptor panels 174 and 418. Panels 422 sandwich a main panel 424. Mounted to the top edge of the upper receptor panel 422 is an I-beam 426, similar to I-beam portion 40; such mounting may be accomplished by forming a lip on the underside of the lower flange of the I-beam 426 for engagement with the upper panel 422. I-beam rafter 354 may be supported in part by posts 420 and 418.

From FIGS. 29 and 42, it can further be appreciated that cells, such as adjacent cells 428, 430, 432, and 434 may be open relative each other by virtue of the roof structure 34 being supported by the exterior wall posts and by central post formations 246C and 248A. Cells 436 and 438 may be closed off by interior wall assemblies for bedrooms or bathrooms or other living space.

Figure 45:
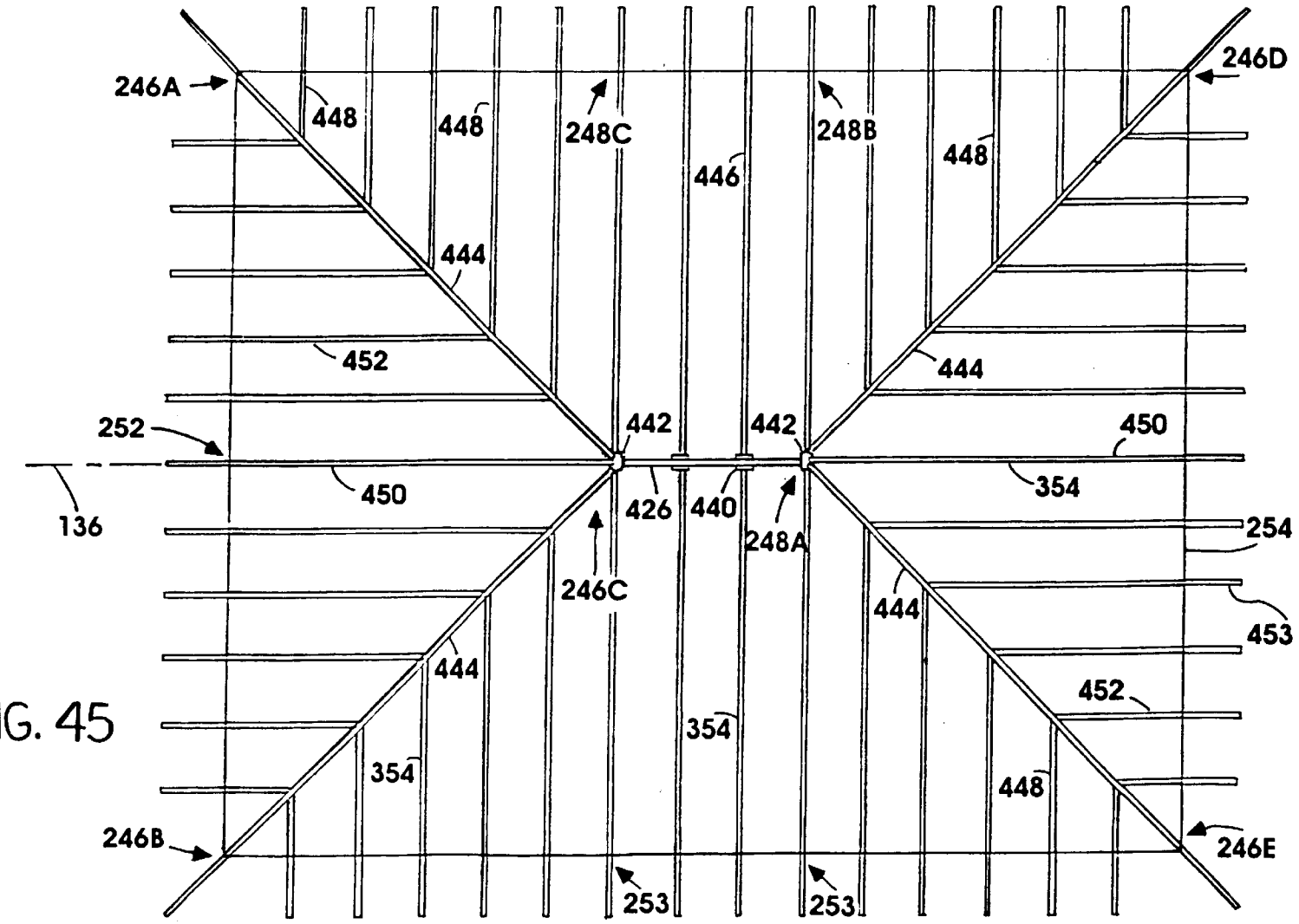
FIG. 45 shows a top view of the roof structure of the shelter of FIGS. 7 and 42.
Figure 47:
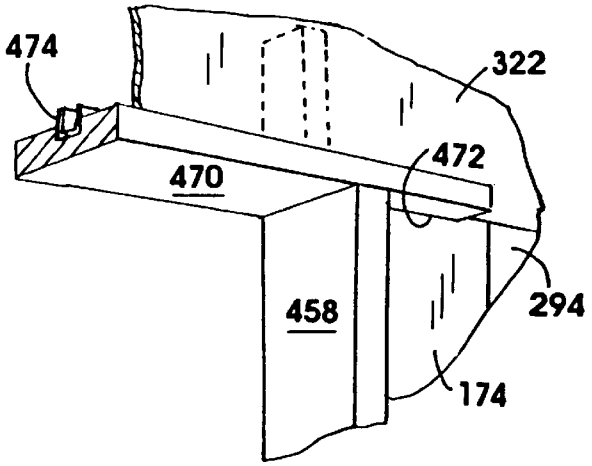
FIG. 47 shows a detail perspective view of the trim of FIG. 46 from the interior of the home.
Figure 48:
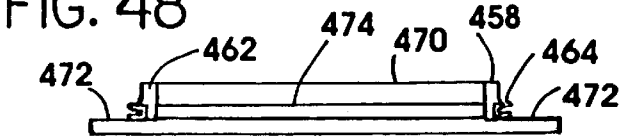
FIG. 48 shows a top view of the trim of FIGS. 46 and 47.

FIG. 45 illustrates the roof structure 34. Each of the rafters 354 is an I-beam identical to I-beam portion 40. It can be appreciated that each of the I-beam rafters 354, with the exception of rafter 426, is supported relative to an exterior wall and transmits load thereto and vice versa. Apex rafter 426 includes hangers 440 and 442 for engaging other rafters 354. Rafters 444 extend from apex rafter 426 to corner posts formed by the exterior walls. Some laterally extending rafters 446 extend between the apex rafter 426 and exterior walls and other laterally extending rafters 448 extend between corner rafters 444 and exterior walls. Ridge rafter 450 extends longitudinally between the apex rafter 426 and an exterior wall. Other longitudinally extending rafters 452 extend between corner rafters 444 and exterior walls. Rafter tails 453 extend beyond the sidewall assemblies.

Figure 49:
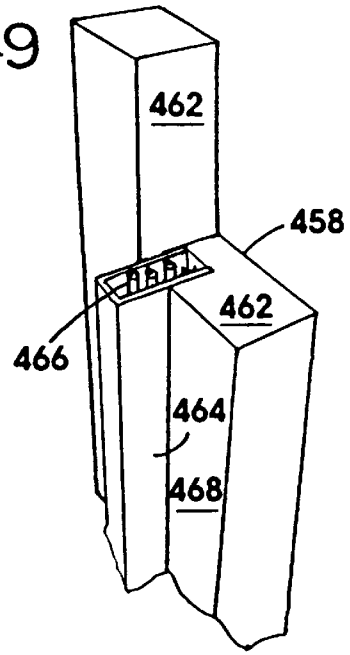
FIG. 49 shows a perspective partial view of trim for an opening having a channel formed therein for receiving a conduit which doubles as a male member for reception in a female receptor of a wall partition.

A frame or trim arrangement 454 for, by way of example an opening 456 for a door, is shown in FIGS. 46, 47, 48 and 49. The opening 456 may be formed by not including partitions 338 and 298 in the sidewall assembly 254 or by taking such out after assembly. The frame arrangement 454 includes a pair of vertical support members 458 of dimensional lumber, such as shown in FIG. 49. Each of the vertical support members 458 includes a lower cut out portion formed by an L-shaped edge 460 for engaging both of the flanges 42 and 44 of the box beam 14 as well as one floor panel 18 such as with pin connectors 461 or adhesive or both. Each of the vertical support members 458 includes an upper cut out portion formed by an L-shaped edge 462 which engages the header 322 such as with pin connectors 461 or adhesive or both and a cross member 470. Each of the vertical support members 458 further includes a male member 464 having a conduit therein for articles such as electrical wires 466. The male conduit or channel member 464 is recessed centrally on the inner face 468 of the support member 458 and is received in the female receiver 178 between panels 174 of a partition, such as partitions 276 and 294 where partitions 338 and 298 are not included in the wall assembly.

The frame arrangement 454 further includes the horizontal support member 470 for mating with vertical support members 458. Horizontal or cross member 470 includes on each end a cut out portion formed by an L-shaped edge 472 for engaging the L-shaped edge 462 of the upright support members 458 and for engaging the inner receptor panels 174. Cross member 470 also includes a male conduit or channel member 474 for the reception of articles such as a set of four electrical wires 466 and for being received in the elongate female receiver 336 of header 322. Open end portions of the male conduit members 464 and 474 are adjacent each other for leading articles such as the electrical wires 466 from one open end of one conduit member to the open end of the other conduit member so that such article may be disposed about three sides of the opening 456.

Figure 51:
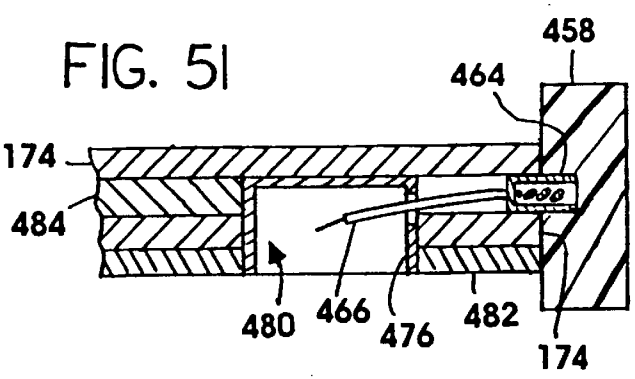
FIG. 51 shows the electrical box of FIG. 50 received in the wall partition and a wire extending through the slot formed by the female receptor, through the knock outs, and into the electrical box.
Figure 52:
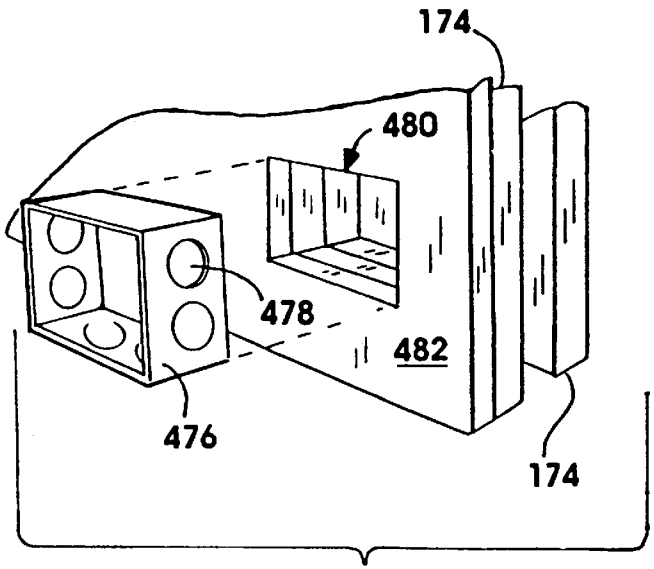
FIG. 52 shows a perspective view of the sheet rock, female receptor, electric box and opening formed therefor.
Figure 50:
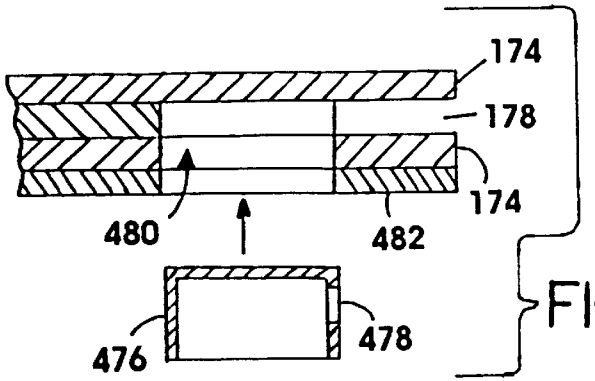
FIG. 50 shows a section view of a wall partition having sheet rock and receiving an electrical box and illustrates how such is mounted adjacent the slot or channel or receiver formed by the female receptor.

As shown in FIGS. 50, 51, and 52, articles such as electrical wires 466 may extend into an electrical outlet box 476 with knock outs 478. Knock outs 478 are in line with female receiver 178. Box 476 may be located in an opening 480 formed in sheet rock 482 and one receptor panel 174. Box 476 may engage an edge of a main panel 484 of a partition. Articles such as the wires 466 may extend out of the open channel of male conduit portion 464 to extend into the box 476 or to a light switch mounted chest high.

Figure 46:
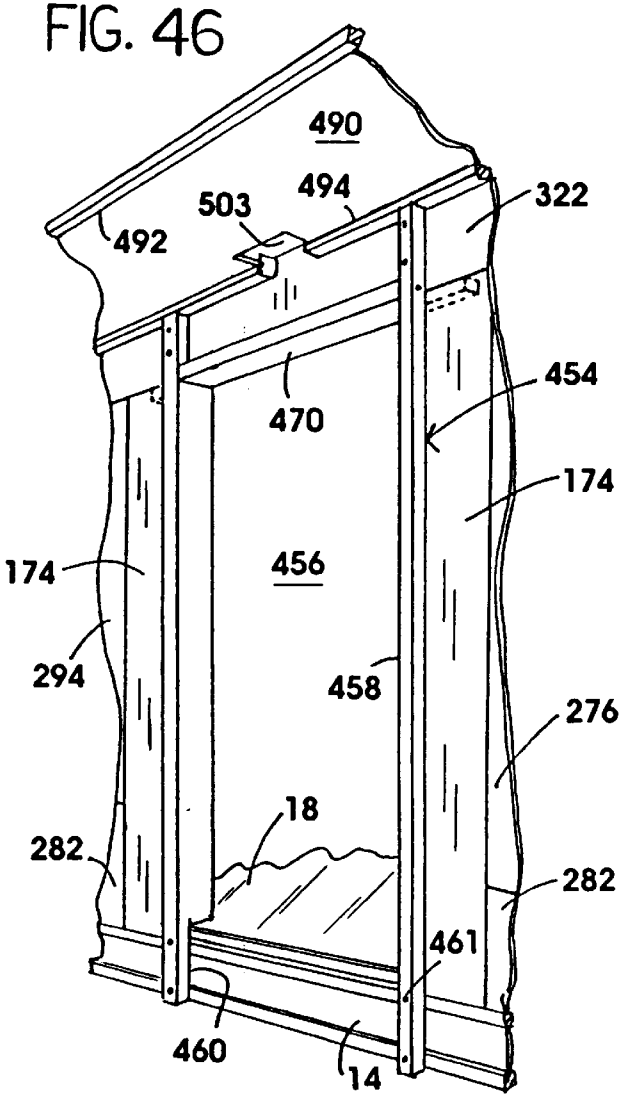
FIG. 46 shows a detail perspective view of trim for a door opening from the exterior of the home and also illustrates the soffit of the present invention.
Figures 53, 54, 55:
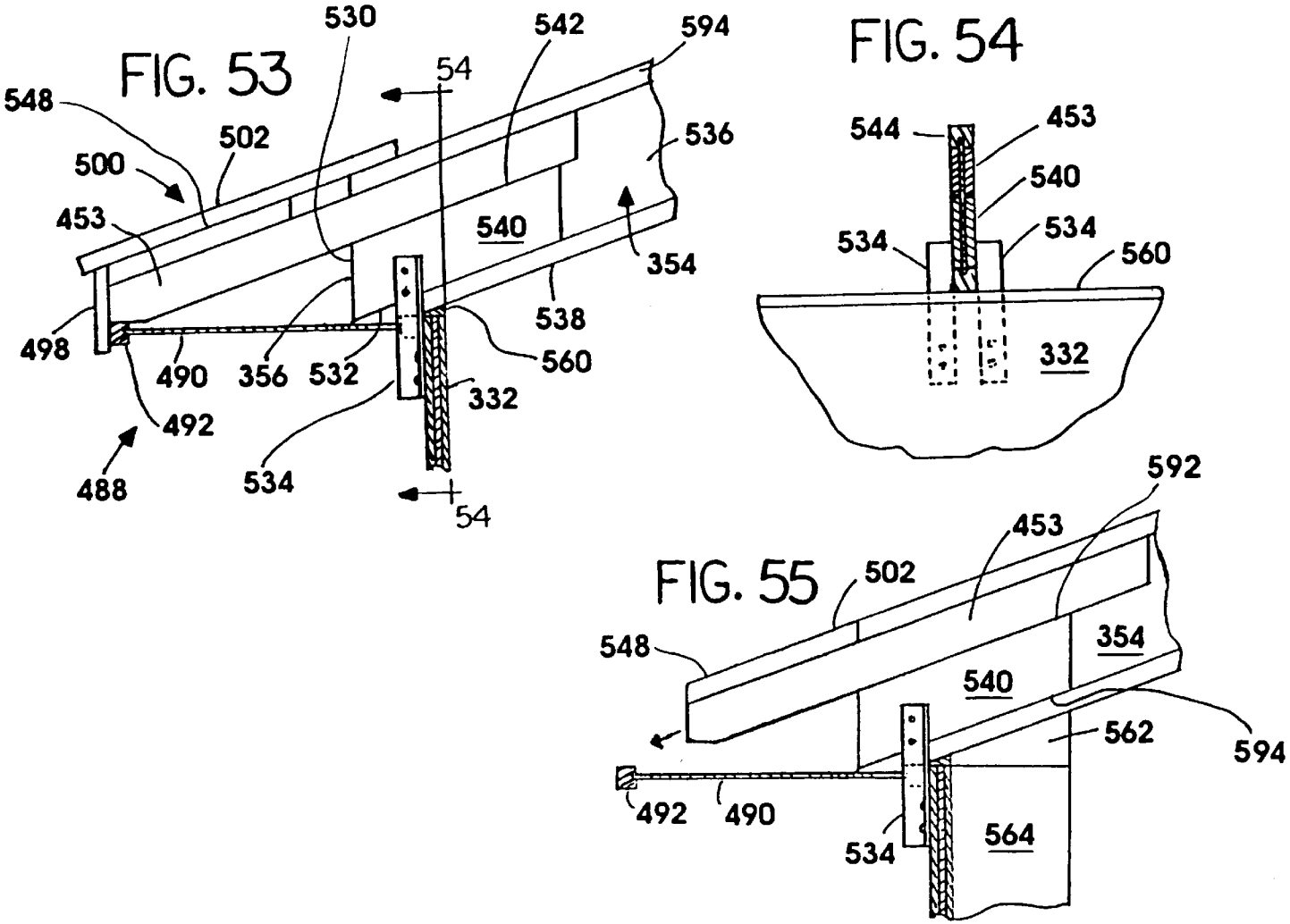
FIG. 53 shows a section view of the soffit I-beam of the present monolithic home, illustrates the monolithic connection between the wall partition and the roof structure between posts, and shows a slidingly adjustable rafter tail.
FIG. 54 shows a section view at lines 54—54 of FIG. 53.
FIG. 55 shows the monolithic connection between the wall partition and roof structure at a post (with a tying panel removed) and illustrates the sliding of the adjustable tail

A soffit 488 formed by an I-beam is shown in FIGS. 46 and 53. The soffit 488 is formed like I-beam portion 40 except that soffit 488 includes a web 490 of a greater expanse (or width or height). The web 490 includes tapered edges and layered flanges 492 and 494 like I-beam portion 90. The soffit 488 extends from an exterior wall partition 332 to fascia 498 of a roof overhang 500 of a roof 502. The soffit 490 provides aesthetic and structural features; it permits the roof overhang 500, fascia 498, as well as the roof 500 and its I-beam rafters as a whole to withstand higher wind loads. From FIG. 46, it can be noted that a portion of the web 490 and inner flange 494 is cut away to form a ventilation opening 503 into the roof overhang structure 500 and entire roof structure 34.

Figure 60:
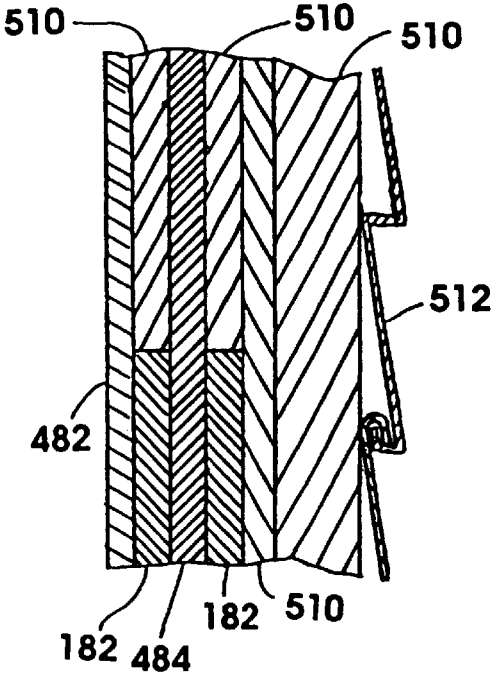
FIG. 60 shows a section view of a finished wall for the present home and illustrates siding, insulation, a wall partition portion, and sheet rock.
Figure 59C:
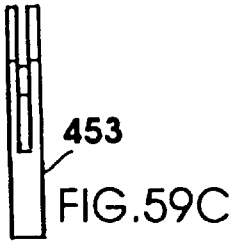
FIGS. 59A, B, C, D, E show side, top, end, bottom, and opposite end plan views, respectively, of the sliding rafter of FIGS. 53–58.
Figure 59B:
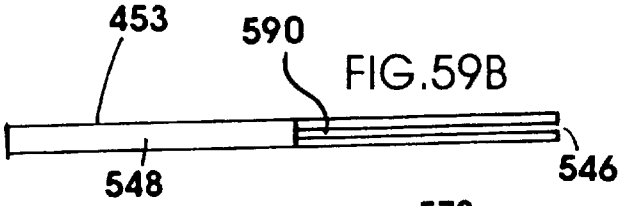
Figure 59A:
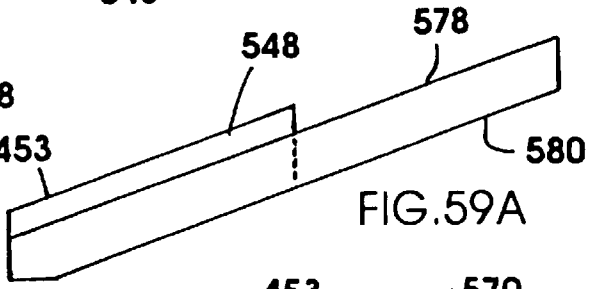
Figure 59D:
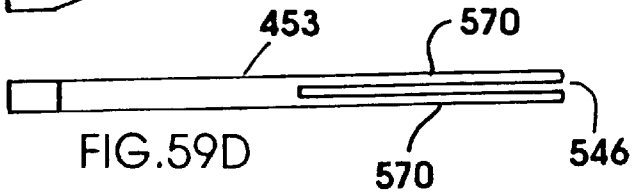
Figure 59E:
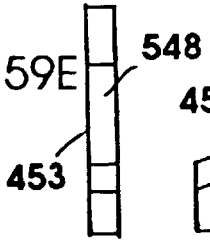

As shown in FIG. 60, rigid foam insulation 510 may be used on the shell 36. The insulation 510 may be disposed in layers between siding 512 and an exterior wall partition including reference locators 182 and a main panel 484. Further, the rigid foam insulation 510 may be disposed between the main panel 484 and sheet rock 482. It should be noted that the siding 512 is mounted via the furring strips, whether such furring strips are panels 174, or other furring strips such as 175 or 197.

Figure 61:
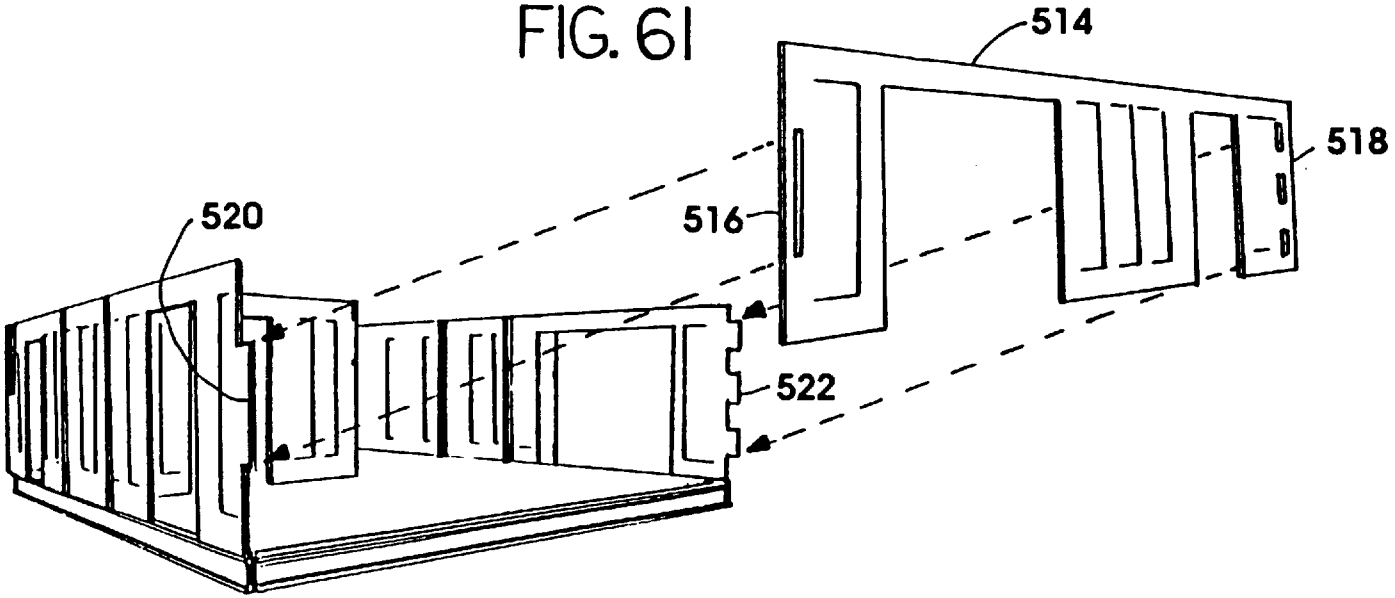
FIG. 61 shows a mortise and tenon arrangement for a sidewall of another embodiment of the invention where the entire sidewall is prefabricated.

As shown in FIG. 61, in another embodiment of the invention, a wall assembly 514, similar to wall assembly 254, may be entirely prefabricated. In such a case, end portions of the wall assembly 514 may have a mortise structure 516 or a mortise structure 518 for engagement with respective tenon structures 520, 522. As to such mortise-tenon arrangements, the Leslie U.S. Pat. No. 5,351,453 is hereby incorporated by reference in its entirety.

As shown in FIG. 53, at nonpost two foot centers formed, for example, by female panels 174 abutting header 332, or between partitions 256 and 276, or between partitions 276 and 338 (and 300), the roof overhang structure 500 includes an I-beam rafter 354 having a terminating end 530 with a notch 532. At the notch 532 is fixed connection hardware such as a pair of angle irons 534 fastened by pin connectors to the web 536 (and possibly flange 538) of the I-beam rafter 354 and to a header or female panel 174 or to an upper reference locator or scab. A block or web stiffener 540 of trapezoidal shape is fixed on the web 536 and abuts the flange 538 with its lower edge and includes an upper track forming edge 542. Block 540 is on each face of the web 536. Edge 542 forms a track with I-beam flange 544 which runs parallel to the edge 542. Between the edge 542 and flange 544 and in the track runs the slideable rafter tail 453. As shown in FIGS. 59A–E, the slideable rafter tail 453 includes a longitudinally extending groove 546. A strip 548 of two-inch by two-inch dimensional lumber is fixed on the tail 453 to run in line with I-beam flange 544. Groove 546 is engaged by the web 536 and permits, as shown by comparing FIGS. 55 and 56, the rafter tail 453 to be extended out to meet flange 492 of the soffit 490 and fascia 498. After extension, pin connectors may be driven through rafter tail 453 and web 536 or flange 594. Further, it should be noted that an elongate wedge 560 runs the entire perimeter of the shelter on the wall partitions and is wedged between the upper edge of the wall partitions and the lower flange 538 of the I-beam rafters 354. The rafter-wall connection in FIG. 53 is monolithic by virtue of the wedge 560, connection hardware 534, and I-beam soffit to rafter tail connection.

Figure 56:
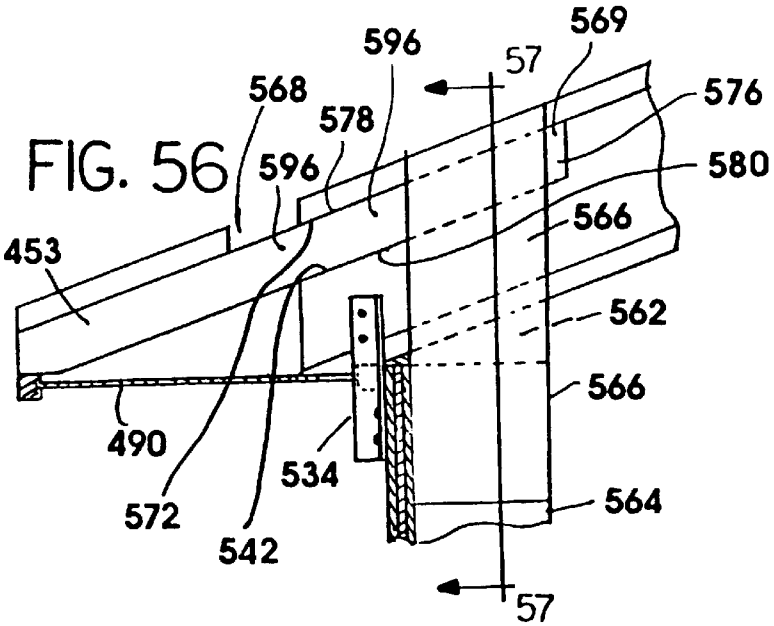
FIG. 56 shows the monolithic connection between the wall partition and roof structure at a post with the tying plate engaged to the rafter tail after the rafter tail has been slid into engagement with the soffit, and further illustrates a finishing piece for fill.
Figure 58:
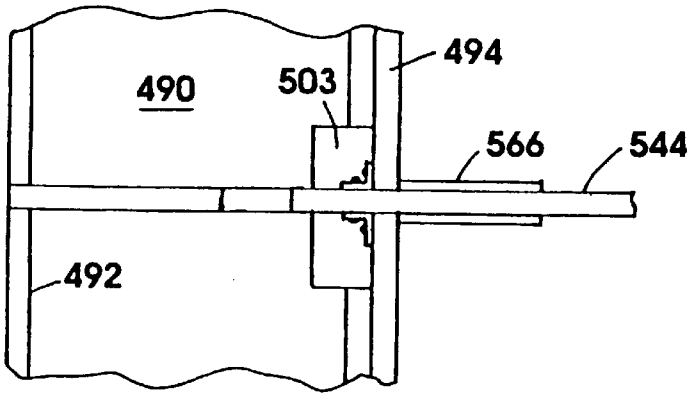
FIG. 58 shows a top view of the sliding, adjustable rafter tail with the roof cut away.

FIG. 56 shows the rafter-wall monolithic connection at a post formed by slotted partitions. Such a connection is identical to the rafter-wall connection between posts, except that it includes a larger wedge 562 extending between one partition 564 and the lower flange 538 of I-beam rafter 354, and except that it includes a pair of tie-in plates 566 fixed to partition 564, such as at its upper scabs, and extending above its scabs to engage, such as with the aid of adhesive or pin connectors or both, the sides of wedge 562, flange 538, block 540, slideable rafter 453, and flange 544. Wedge 562 is actually trapezoidal; it abuts the elongate, perimeter extending smaller wedge 560. The wedges 560 and 562 are formed of dimensional lumber, as is slideable rafter 453. Tie-in plates 566 are formed of oriented strand board.

FIG. 56 further shows that, as slideable rafter tail 453 may be slid out of I-beam rafter 354 where it is stored, a gap 568 may be formed between flange 544 and the upper end of strip 502. In actuality, this gap is preferably no more than one-half inch.

It can be appreciated that the entire shell 34, with the exception of the I-beam flanges, hangers 440, and 442, support members 134, 148, 420, 458, and 470, may be formed of oriented strand board.

It can be appreciated that another characteristic of oriented strand board is that it is fire resistant. Because of the chemical make up of oriented strand board, including the phenolic resins, and because of the pressures used to form such board, oriented strand board produces a relatively inflammable char at its surfaces which renders the rest of the board relatively fire resistant.

It should be noted that the weatherproof panel system adhesive is solvent resistant, heat and water resistant, sets fast, is paintable, sands easily, is solvent-free, nontoxic, cleans up with water, and is FDA approved for indirect food contact. One type of such adhesive is a crosslinking polyaliphatic emulsion.

It can further be appreciated that the vast majority of components in the shelter are preferably formed of an organic matter, more preferably of wood, and most preferably of oriented strand board.

As shown in FIGS. 53–60 and described above, main rafter or I-beam rafter 354 includes the terminating or outer end 530. Each of the rafter tail 453 and I-beam rafter 354 is preferably formed of an organic matter, more preferably of wood, and most preferably of oriented strand board. As further indicated above, the entire shell 34 with some exceptions may be formed of oriented strand board. The rafter tail 453 is preferably formed of oriented strand board with the exception of the strip 458 of dimensional lumber which runs in line with the I-beam flange 544. The rafter tail 453 includes a slot or groove 546.

As described above, edge 542 forms a track 569 with I-beam flange 544 which runs parallel to edge 542. The track 569 is formed on each side of the I-beam rafter 354 and a rafter tail section 570 runs in each of the tracks 569. It can be appreciated that the track is formed by the edge 542 of the web stiffener plank portion 540, an edge 572 of the I-beam flange 544, and one of the faces 576 of the web 536 and that such three components 542, 572, and 576 confront and slidingly engage against rafter tail section edges 580 and 578 and rafter tail section face 590. It can thus be appreciated that vertical loads are transmitted by the rafter tail sections 570 as well as the web 536.

As shown in FIG. 60, rafter tail sections 570 are integral with each other. Via the slot 546, rafter tail sections 570 run about the outer end 530 of I-beam rafter 354.

It can be appreciated that portion of the web 536 between the tracks 569 may be described as a base common portion for the tracks 569.

Figure 57:
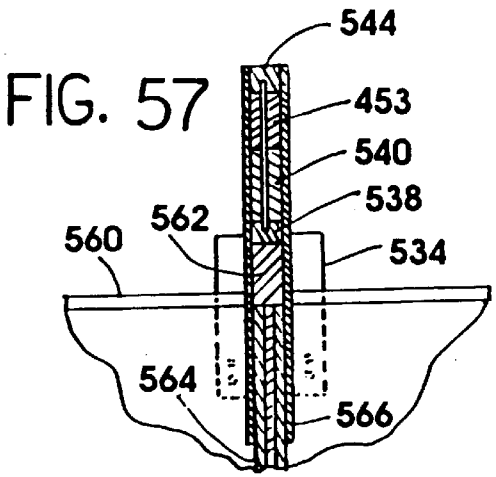
FIG. 57 shows a section at lines 57—57 of FIG. 56.

As indicated in FIG. 57, the flanges 544 of the I-beam rafter 354 have a lateral width greater than the lateral thickness of the web 536.

As shown in FIG. 55, web stiffener 540 includes an edge 592 confronting and engaging the rafter tail section 570 and another edge 594 confronting and engaging a lower flange 538 of the I-beam rafter 354 such that load is transmitted to and between the flanges of the I-beam rafter 354 via the web stiffeners 540 and rafter tail sections 570 as well as the web 540. As shown in FIG. 57, the lateral thickness of the web stiffeners 540 is such that the outer faces of the web stiffeners 540 lie flush or in a common plane with the outer faces of the rafter tail sections 570, which further lie flush or in a common plane with outer faces of flanges 538 and 544 such that tie-in plates 566 may lie flat over and upon the web stiffeners 540, faces of the flanges 538 and 544, and faces of the rafter tail sections 570. The web stiffener 540 is preferably formed of an oriented strand board.

After extension of the rafter tail 453 to meet flange 492 of the soffit 490 and fascia 498, pin connectors 596 may be driven through rafter tail section 570 and web 536. Further, if desired, an adhesive may be squeezed between the rafter tail sections 570 and flange 544 or web 536.

As shown in FIGS. 53–57, one web stiffener 540 and its respective rafter tail section 570 define a layer of wood or oriented strand board which transmits a load between the flanges 538 and 544 of I-beam rafter 354. Accordingly, one I-beam rafter 354 includes three layers of preferably oriented strand board (or wood or organic matter) transmitting loads to and between the I-beam flanges 538 and 544.

As indicated above, pin connectors such as nail or screws alone may be used to engage the various components, such as the I-beam soffit 488 to the wall structure 332 or the I-beam soffit 488 to the rafter tail 453 and fascia 498. The use of adhesive and pin connectors with such soffit connections is more preferred to the use of an adhesive alone or the use of pin connectors alone.

As indicated in FIG. 8, the soffit 488 extends about at least a portion of the perimeter of the outside wall structure of the shelter 38. FIG. 8 further shows fascia 498 traveling about a perimeter of the shelter 38. FIGS. 53, 55, and 56 indicate that the soffit 488 is fixed to the rafter tail 453 and fascia 498.

As indicated above, the entire shell 34, with the exception of the I-beam flanges, hangers 440, and 442, support members 134, 148, 420, 458, and 470, may be formed of oriented strand board. Accordingly, the web 490 of the I-beam soffit 488 is preferably formed of an organic matter, more preferably formed of wood, even more preferably formed of compressed wood strands arranged in layers at generally right angles to one another and bonded with a waterproof adhesive, and most preferably of oriented strand board. The flanges of the I-beam soffit 488 may be formed of dimensional lumber such as plywood.

The web 490 of the I-beam soffit 488 extends at a generally right angle to the wall structure of the shelter 38. A portion of the wall structure, specifically header 332, is shown in FIGS. 53, 55, 56.

As indicated above, posts or furring strips or nailers are placed at two-foot centers about the wall partition arrangement. Accordingly, panel strips or post portions 600 as shown in FIGS. 30 and 31 are affixed on one of the faces of panels that are placed below headers and that close off openings otherwise intended for doors or windows. Such panels, for example, may be panels 300 and 338. The panel strips or post portions 600 have a thickness such that their faces lie flush with the faces of reference locators such as reference locator 310. Further, each of the panel strips 600 have upper and lower edges for confronting and abutting horizontally oriented pieces, such as reference locator 310 and such as a bottom edge portion of header 322. Panel strips 600 lie on each of the faces of their respective panels to provide, with the panel itself a three layer thickness to its respective post. Such panel strips or post portions 600 are also placed on both of the faces of second story panels 414 and 424 to maintain the two-foot centers.

As shown in FIG. 40, a generally horizontally disposed partition 602 may be placed between two post portions or female receptor panel strips 174. The partition 602 includes two outer panel portions and one inner or central panel portion and is slidingly engaged in one of the receivers 20. Partition 602 includes a female receiver 603 formed by the outer two panel portions and the upper edge 604 of the central panel portion. Partition 602 further includes a pair of male panel sections 605, each of which is engaged between female receptor panels 174 and each of which confronts and abuts edge 387. Male panel sections 605 are integral with the central panel portion. Accordingly, a window or window frame for opening 359 may be captured about its entire periphery by female receptors formed by partition 602, partitions 390 and 388, and header 368. Partition 602 may be less elongate when trim portions 392 (shown in FIG. 41A and 41B) are used.

As shown in FIG. 49, the channel member 464 may be placed in its vertical support member 458 such that the support member 458 closes off the open channel of member 464. Channel member 474 (in FIG. 47) further may be turned around so as to close off its channel with the horizontal support member 470.

Figure 62:
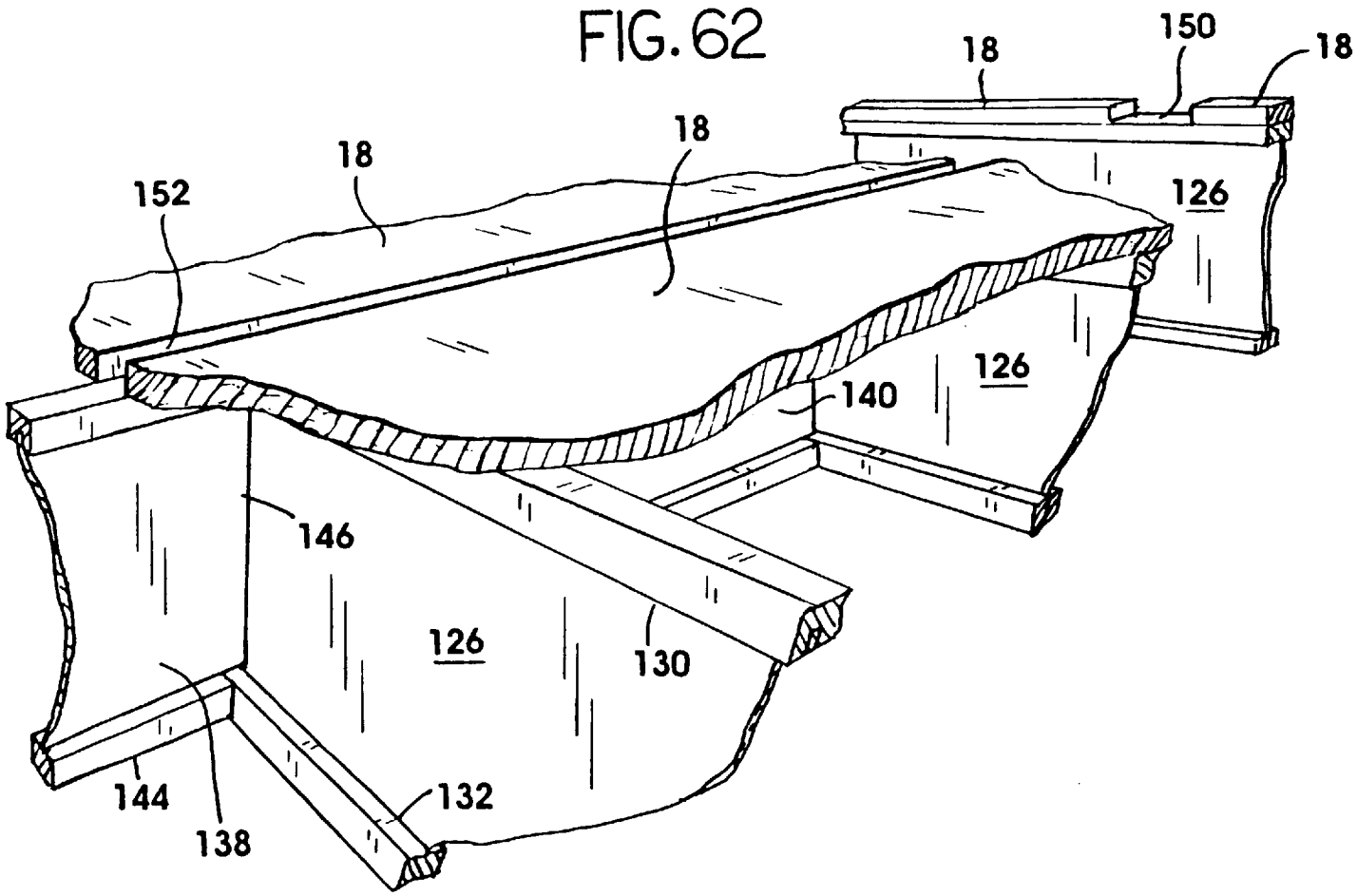
FIG. 62 shows a perspective, detail view of a portion of the base and illustrates the wall partition receiving channels base portions formed by the upper flanges of the relatively short I-beam and flange portions of the crossing elongate I-beam, and wall partition receiving channel side portions formed by floor panels.
Figure 63:
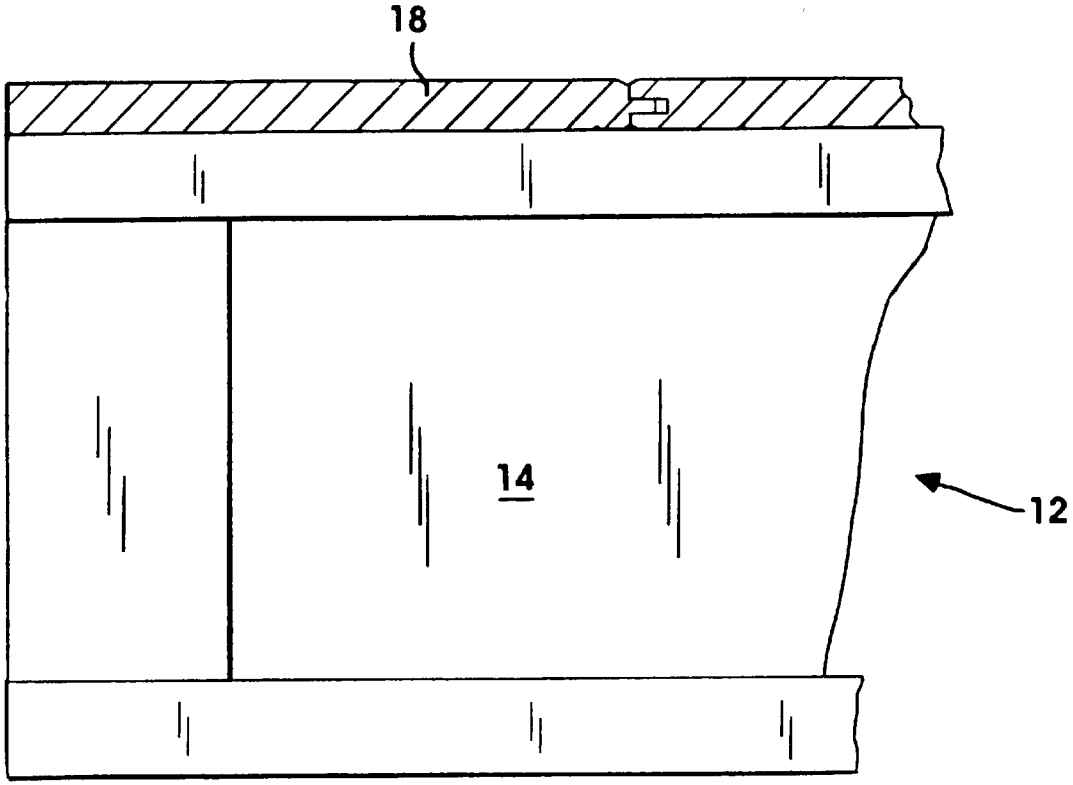
FIG. 63 shows interlocking floor panels mounted directly on base I-beams.

As shown in FIGS. 62 and 63, the sleepers or two inch by two inch strips of dimensional lumber may left out of the base. In such a case, the interlocking floor panels 18 are mounted directly on the box beams 14 and 16 or I-beams 126 or other I-beams. Also in such a case, the wall partition receiving channel 152 may be formed in the interlocking floor panels 18, such as by routing out portions of the interlocking floor panels 18 disposed over the flanges of the box beams 14 and 16 or I-beams 126 or other I-beams. Accordingly, the base portions of the receiving channels 152 are formed by the I-beams flanges and the side portions of the receiving channels are formed by the side portions of the interlocking floor panels 18. Mounting the floor panels 18 directly on the I-beams creates more open space—a higher ceiling—in the monolithic shelter.

Figure 64:
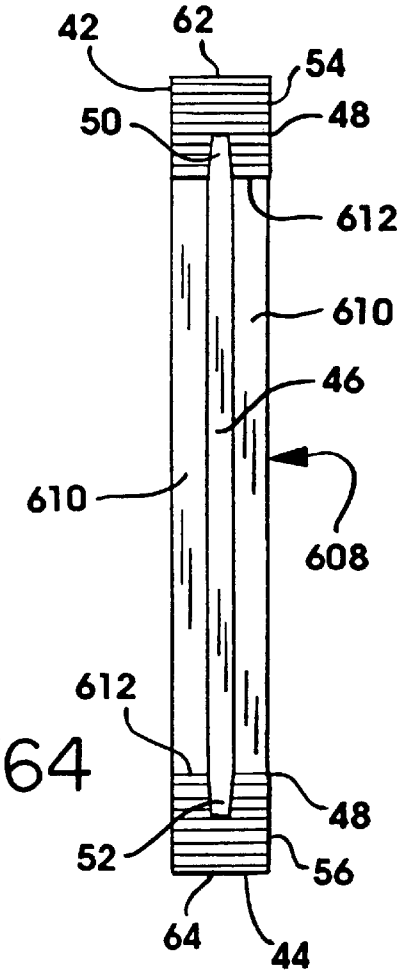
FIG. 64 shows a section view of an I-beam with elongate web blocks.
Figure 65:
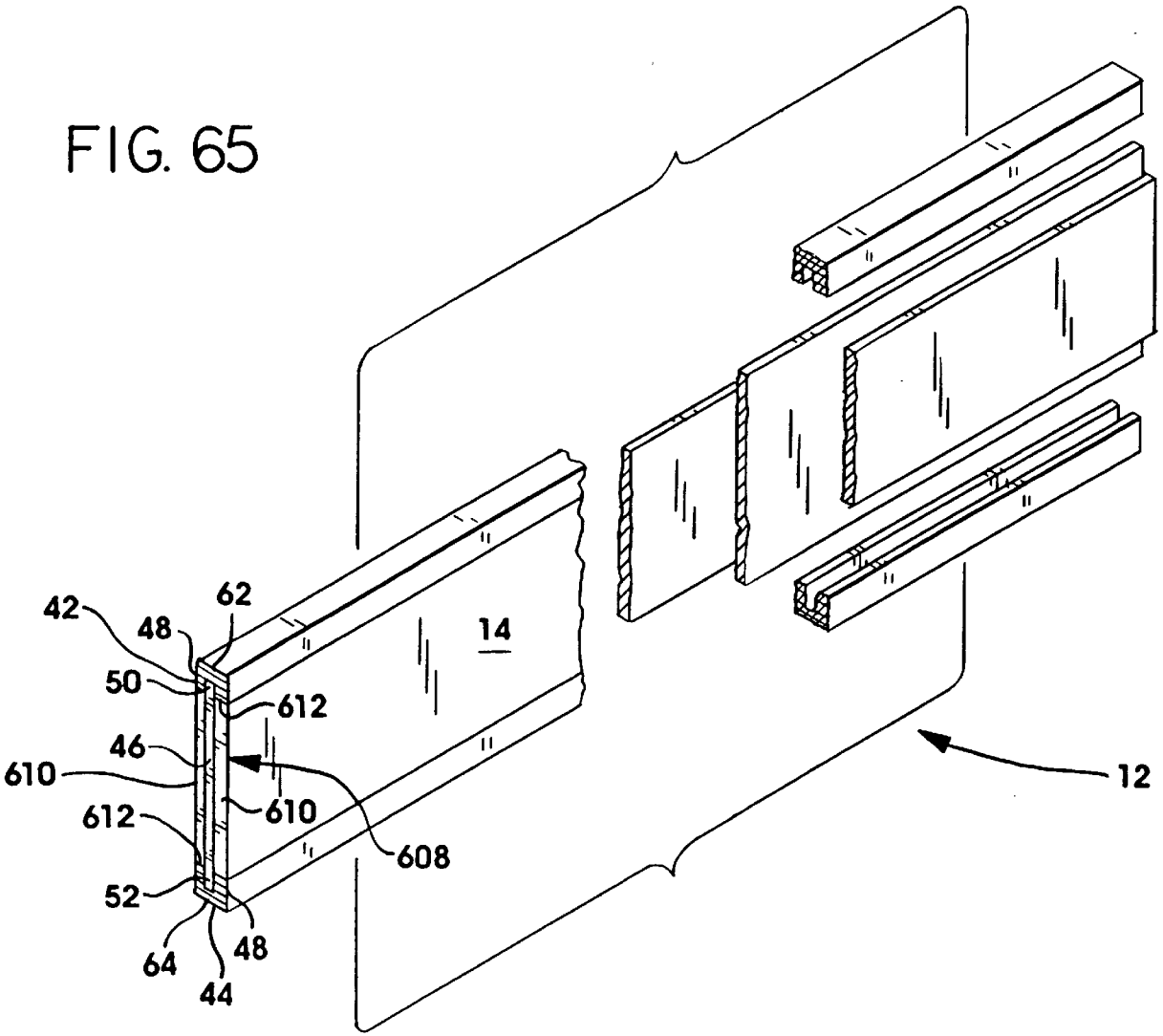
FIG. 65 shows an exploded view of an I-beam with elongate web blocks.

As shown in FIGS. 64 and 65, an I-beam 608, preferably used as a rafter, includes elongate flange-to-flange web stiffeners 610 fixed to and between elongate inner flange faces 612 and further fixed to faces of the web 46. Such fixing may be carried out with an adhesive or pin connectors or both. I-beam 608 thereby includes three webs or web portions (portion 46, portion 608 on one face of web portion 46, and portion 608 on the other face of the web portion 46)

for transferring loads to and between the flanges 42 and 44. Such a load transfer is disclosed above, where the rafter tail 453 forms one portion of a flange-to-flange web stiffener and web stiffener 540 forms the other portion of such a flange-to-flange web stiffener. I-beam 608 is preferably used as a rafter, such as one of the rafters indicated in FIGS. 7, 42, 45, and 53–58. Web stiffeners 610, along with web 46, are preferably formed of compressed wood strands arranged in layers at generally right angles to one another and bonded with a waterproof adhesive and more preferably formed of oriented strand board. I-beam 608 includes the web 46 and flanges 42 and 44 described in connection with FIGS. 9–13.

As to FIG. 61, wall assembly 514 includes a central integral panel running from end to end and from the lower edge portions to the upper edge portions. Furring strips or post panel portions, and upper and lower reference locators may, if desired, be integral with each other on one side or face of the central integral panel. Such a wall assembly may measure eight feet by 24 feet, a standard size for oriented strand board.

It should be noted that the adjustable rafter 453 includes: a) a main rafter having an inner end portion and an outer end portion, with the outer end portion being adjacent to a wall of a structure, with the main rafter defining a longitudinal direction; and b) a rafter tail slideably engaged with the outer end portion of the main rafter, with the rafter tail being slideable in the longitudinal direction to a position relative to the outer end portion whereby the rafter tail may be laterally aligned with a plurality of other rafter tails. The rafter tail and main rafter each comprise organic matter. The rafter tail is longitudinably slideable to a postion away from the outer end portion to be aligned with the other rafter tails. One of the outer end portion and rafter tail includes a slot and the other of the outer end portion and rafter tail includes a section engaging the slot. One of the outer end portion and rafter includes a track and the other of the outer end portion and rafter tail includes a section riding in the track. One of the outer end portion and rafter includes a pair of tracks and the other of the outer end portion and rafter tail includes a pair of elongate sections riding in the track, with the tracks running parallel to and opposite of each other and sharing a base portion, and with the pair of elongate sections forming a slot therebetween for reception of the base portion of the track. Each of the tracks and elongate sections include three elongate side edges, with the three elongate sides of each of the tracks confronting each of the elongate sides of one of the sections whereby load is transmitted between the tracks and sections and thereby between the rafter tail and main rafter. The main rafter may comprise an I-beam. The I-beam is formed of organic matter and includes an elongate web having a pair of elongate side edges running longtidunially with the web and a pair of elongate flanges fixed on and running parallel to the elongate side edges, with the flanges having a lateral width greater than the lateral thickness of the web. The I-beam may further comprise a pair of elongate web stiffeners, with each of the web stiffeners comprising an elongate plank portion of organic matter, with each of the web stiffeners having a pair of opposite elongate side edges, with at least one of the elongate side edges of the web stiffeners confronting one of the flanges. Each of the web stiffeners includes outer and inner faces defining a lateral thickness of its respective web stiffener and wherein each of the flanges includes a pair of faces defining a lateral width of its respective flange, and wherein the lateral thickness of the web stiffener is sufficient such that the outer face of each of the web stiffeners is generally flush with one of the faces of the flange which such web stiffener confronts. The other of the elongate side edges of the web stiffener forms a portion of a track for slidingly receiving the rafter tail. The adjustable rafter may include a fastener for fixing the rafter tail relative to the main rafter after the rafter tail is aligned with the other rafter tails. The adjustable rafter may include means for fixing the rafter tail relative to the main rafter after the rafter tail is aligned with the other rafter tails. The adjustable rafter may include the step of fixing the rafter tail relative to the main rafter after the rafter tail is aligned with the other rafter tails.

The adjustable rafter 453 may include a) a main rafter comprising an I-beam, with the I-beam having an inner end portion and an outer end portion, with the outer end portion being adjacent to a wall of a structure, with the I-beam defining a longitudinal direction, and with the I-beam being formed of organic matter and including an elongate web having a pair of elongate side edges running longitudinally with the web and a pair of elongate flanges fixed on and running parallel to the elongate side edges, with the flanges having a lateral width greater than the lateral thickness of the web; and b) a rafter tail slideably engaged with the outer end portion of the I-beam, with the rafter tail being slideable in the longitudinal direction to a position relative to the outer end portion whereby the rafter tail may be laterally aligned with a plurality of other rafter tails, with the rafter tail slidingly engaging the I-beam at a position between the flanges and with the rafter tail slidingly engaging the web and at least one of the flanges. The rafter tail may include a web stiffener plank portion between the rafter tail and one of the flanges, with the web, web stiffener plank portion, and the other of the flanges forming a track for slidingly receiving at least a portion of the rafter tail. Each of the web stiffener plank portion, rafter tail and each of the flanges includes a face portion, and wherein each of the face portions is generally flush with each of the other face portions.

The rafter 354 maybe formed of organic matter and include a) a main rafter portion comprising an organic I-beam, with the I-beam having an inner end portion and an outer end portion, with the outer end portion being adjacent to a wall of a structure, with the I-beam defining a longitudinal direction, and with the I-beam including an elongate web having a pair of elongate side edges running longitudinally with the web and a pair of elongate flanges fixed on and running parallel to the elongate side edges, with the web having a pair of first and second faces defining a lateral width of the web, with the flanges having a lateral width greater than the lateral thickness of the web, with each of the flanges having a pair of first and second inner edges and a respective pair of first and second faces, with the first inner edges of the flanges facing each other and with the second inner edges of the flanges facing each other, with the first faces of the flanges lying in generally a first plane and with the second faces of the flanges lying in a second plane; and b) first and second organic layers of organic matter on each of the faces of the web and running to and between the flanges such that the first organic layer runs to and meets the first inner edges on the first face of the web and such that the second organic layer runs to and meets the second inner edges on the other face of the web, with each of the organic layers on each face of the web having an outer face, with the outer face on the first face of the web lying in the first plane and with the outer face on the second face of the web lying in the second plane whereby load is transmitted to and between the flanges via the web and via the each of the organic layers on each face of the web. Each of the organic layers is slideable relative to a second portion of each of the organic layers, with the portions of the organic layers being integral with each other and running around the outer end portion of the I-beam to form one-piece, with such one-piece slidingly engaging one of the flanges and having an end which is slideable away from the outer end portion of the I-beam.

The soffit 488 is preferably for a shelter having a roof overhang and a wall structure. The soffit 488 preferably extends between the wall structure and the roof overhang and includes an I-joist, with the I-joist having an elongate web with a pair of opposing elongate edges and a pair of flanges on each of the elongate edges, with one of the flanges engaged to the wall structure of the shelter and traveling along at least a portion of a perimeter of the wall structure, and with the other flange engaged to a portion of the roof overhang and following such travel of the flange engaged to the wall structure. The elongate web is fixed at generally a right angle to the wall structure. The I-joist is preferably formed of an organic matter. The elongate web is preferably formed of compressed wood strands arranged in layers at generally right angles to one another and bonded with a waterproof adhesive and more preferably formed of oriented strand board. The elongate web may be formed of oriented strand board and the flanges may be formed of dimensional lumber. The roof overhang may include a plurality of rafters, with one of the flanges of the I-joist being fixed to the rafters and traveling between the rafters. The rafters may be formed of I-beams extending from the wall structure to an apex of the shelter. The roof overhang may include fascia and one of the flanges of the I-beam soffit may be fixed to the fascia. A portion of the flange of the I-beam soffit which is engaged to the wall structure may be cut away whereby the shelter may be ventilated through the soffit. A portion of the web of the I-beam soffit may be cut away whereby the shelter may be ventilated through the soffit. Each of the flange and the web of the I-beam soffit may include a through portion formed therein whereby the shelter may be ventilated through the soffit.

Thus since the invention disclosed herein may be embodied in other specific forms without departing from the spirit or general characteristics thereof some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. A modified box beam, comprising, in combination:

a) an elongate web having opposite edge portions and opposite side portions;

b) a pair of elongate flanges running parallel to each other and along the opposite edge portions of the elongate web, with each of the opposite edge portions extending at least partially into the flanges, with the elongate web and elongate flanges forming an I-beam portion;

c) a first outer elongate plate member running parallel to the elongate web, with the first outer elongate plate member being fixed to each of the elongate flanges, with the first outer elongate plate member having a side confronting, spaced from, and running parallel to one of the side portions of the elongate web whereby a greater load bearing capacity is provided to the I-beam portion, with at least one of the web, flanges, and first outer elongate plate member being formed substantially of an organic matter; and d) wherein each of the flanges includes opposite faces, and wherein the first outer elongate plate member is fixed to one of the faces of each of the flanges.

2. The modified box beam of claim 1 wherein the outer elongate plate member and elongate web comprise oriented strand board.

3. The modified box beam of claim 1 wherein the outer elongate plate member and elongate web comprise compressed wood strands arranged in layers at generally right angles to one another and bonded with a waterproof adhesive.

4. The modified box beam of claim 3 wherein each of the layers comprises wood.

5. A modified box beam, comprising in combination:

a) an elongate web having opposite edge portions and opposite side portions, b) a pair of elongate flanges running parallel to each other and along the opposite edge portions of the elongate web, with each of the opposite edge portions extending at least partially into the flanges, with the elongate web and elongate flanges forming an I-beam portion;

c) a first outer elongate plate member running parallel to the elongate web, with the first outer elongate plate member being fixed to each of the elongate flanges, with the first outer elongate plate member having a side confronting, spaced from, and running parallel to one of the side portions of the elongate web whereby a greater load bearing capacity is provided to the I-beam portion, with at least one of the web, flanges, and first outer elongate plate member being formed substantially of an organic matter; and d) wherein each of the elongate flanges comprises layers, with each of the layers having a face and an edge, with each of the faces being of greater width than each of the edges, with the faces being at a right angle to the side portions of the elongate web.

6. A modified box beam, comprising, in combination:

a) an elongate web having opposite edge portions and opposite side portions;

b) a pair of elongate flanges running parallel to each other and along the opposite edge portions of the elongate web, with each of the opposite edge portions extending at least partially into the flanges, with the elongate web and elongate flanges forming an I-beam portion;

c) a first outer elongate plate member running parallel to the elongate web, with the first outer elongate plate member being fixed to each of the elongate flanges, with the first outer elongate plate member having a side confronting, spaced from, and running parallel to one of the side portions of the elongate web whereby a greater load bearing capacity is provided to the I-beam portion, with at least one of the web, flanges, and first outer elongate plate member being formed substantially of an organic matter; and d) wherein the first outer elongate plate member includes opposite edge portions each matched with a respective one of said flanges, with one of the opposite edge portions of the first outer elongate plate member extending and terminating beyond the flange with which said opposite edge portion of said first outer elongate plate member is matched such that an "L" shaped receiver is formed at said opposite edge portion of said first outer elongate plate member.

7. The modified box beam of claim 6 and further comprising a second outer elongate plate member, with each of the outer elongate plate members being on opposite side portions of the elongate web and extending and terminating beyond a same flange such that the L-shaped receiver is turned into a channel receiver formed at said opposite edge portions of the first and second elongate plate members.

8. A modified box beam, comprising, in combination:

a) an elongate web having opposite edge portions and opposite side portions;

b) a pair of elongate flanges running parallel to each other and along the opposite edge portions of the elongate web, with each of the opposite edge portions extending at least partially into the flanges, with the elongate web and elongate flanges forming an I-beam portion;

c) a first outer elongate plate member running parallel to the elongate web, with the first outer elongate plate member being fixed to each of the elongate flanges, with the first outer elongate plate member having a side confronting, spaced from, and running parallel to one of the side portions of the elongate web whereby a greater load bearing capacity is provided to the I-beam portion, with at least one of the web, flanges, and first outer elongate plate member being formed substantially of an organic matter; and d) wherein the first outer elongate plate member includes opposite edge portions each matched with a respective one of said flanges, with one of the opposite edge portions of the first outer elongate plate member extending and terminating beyond the flange with which said opposite edge portion of said first outer elongate plate member is matched such that a right angle shaped receiver is formed at said opposite edge portion of said first outer elongate plate member.

9. The modified box beam of claim 8 and further comprising a second outer elongate plate member, with each of the outer elongate plate members being on opposite side portions of the elongate web and extending and terminating beyond a same flange such that the right angle shaped receiver is turned into a channel receiver formed at said opposite edge portions of the first and second elongate plate members.

10. A modified box beam, comprising, in combination:

a) an elongate web having opposite edge portions and opposite side portions;

b) a pair of elongate flanges running parallel to each other and along the opposite edge portions of the elongate web, with each of the opposite edge portions extending at least partially into the flanges, with the elongate web and elongate flanges forming an I-beam portion;

c) a first outer elongate plate member running parallel to the elongate web, with the first outer elongate plate member being fixed to each of the elongate flanges, with the first outer elongate plate member having a side confronting, spaced from, and running parallel to one of the side portions of the elongate web whereby a greater load bearing capacity is provided to the I-beam portion, with at least one of the web, flanges, and first outer elongate plate member being formed substantially of an organic matter; and d) at least two I-beam portions, with the I-beam portions being engaged to each other end to end at a first location, with the first outer elongate plate member spanning the first location.

11. The modified box beam of claim 10 and further comprising, in combination: at least two first outer elongate plate members, with the at least two first outer elongate plate members being engaged to each other end to end at a second location, with the first and second locations being staggered relative to each other.

12. The modified box beam of claim 10 and further comprising, in combination:

a) the first outer elongate plate member including opposite edge portions each matched with a respective one of said flanges, with one of the opposite edge portions of the first outer elongate plate member extending and terminating beyond the flange with which said opposite edge portion of said first outer elongate plate member is matched;

b) a second outer elongate plate member, with each of the outer elongate plate members on opposite side portions of the elongate web and extending and terminating beyond a same flange such that a channel receiver is formed at said opposite edge portions of said first and second outer elongate plate members; and c) with the second elongate plate member spanning the first location.

13. The modified box beam of claim 12 and further comprising, in combination: at least two second outer elongate plate members, with the at least two second outer elongate plate members being engaged to each other end to end at a third location, with the first and third locations being staggered relative to each other.

14. The modified box beam of claim 13 and further comprising, in combination: at least two first outer elongate plate members, with the at least two first outer elongate plate members being engaged to each other end to end at a second location, with the first, second, and third locations being staggered relative to each other.

15. A support structure for use as a building jig, comprising, in combination:

a) a set of first I-beam structures, with each of the first I-beam structures comprising in combination:

i) an elongate web having opposite edge portions and opposite side portions;

ii) a pair of elongate flanges running parallel to each other and along the opposite edge portions of the elongate web, with the elongate web and elongate flanges forming an I-beam portion;

iii) a first outer elongate plate member running parallel to the elongate web, with the first outer elongate plate member being fixed to each of the elongate flanges, with the first outer elongate plate member having a side confronting, spaced from, and running parallel to one of the side portions of the elongate web whereby a greater load bearing capacity is provided to the I-beam portion; and iv) with the first outer elongate plate member including opposite edge portions each matched with a respective one of said flanges, with one of the opposite edge portions of the first outer elongate plate member extending and terminating beyond the flange with which said opposite edge portion of said first outer elongate plate member is matched such that an L-shaped receiver is formed at said opposite edge portion of said first outer elongate plate member; and b) with one of the first I-beam structures being fixed to another said first I-beam structure at an angle.

16. The support structure of claim 15 a) wherein the angle is a right angle;

b) wherein opposite flanges of the set of first I-beam structures lie in one of two respective opposite planes defined by said opposite flanges of said set of first I-beam structures; and c) wherein each of the outer elongate plate members lie at a right angle to the planes whereby a true building jig is provided.

17. The support structure of claim 16 and further comprising, in combination: a first wall portion, with the first wall portion being engaged by the L-shaped receiver, and with the first wall portion extending at a right angle to the planes.

18. The support structure of claim 15 wherein the first outer elongate plate member is disposed inwardly relative to the support structure such that the "L" shaped receiver is disposed outwardly of the support structure.

19. The support structure of claim 15 and further comprising, in combination:

a) at least a second I-beam structure comprising in combination:

i) an elongate web having opposite edge portions and opposite side portions;

ii) a pair of elongate flanges running parallel to each other and along the opposite edge portions of the elongate web of the second I-beam structure, with the elongate web and elongate flanges of the second I-beam structure forming a second I-beam portion;

iii) a first outer elongate plate member running parallel to the elongate web of the second I-beam structure, with the first outer elongate plate member of the second I-beam structure being fixed to each of the elongate flanges of the second I-beam structure, with the first outer elongate plate member of the second I-beam structure having a side confronting, spaced from, and running parallel to one of the side portions of the elongate web of the second I-beam structure whereby a greater load bearing capacity is provided to the second I-beam portion;

iv) with the first outer elongate plate member of the second I-beam structure including opposite edge portions each matched with a respective one of said flanges of said second I-beam structure, with one of the opposite edge portions of the first outer elongate plate member of the second I-beam structure extending and terminating beyond the flange with which said opposite edge portion of said first outer elongate plate member of the second I-beam structure is matched; and v) a second outer elongate plate member, with each of the outer elongate plate members of the second I-beam structure on opposite side portions of the elongate web of the second I-beam structure and extending and terminating beyond a same flange of the second I-beam structure such that a channel receiver is formed at said opposite edge portions of said first and second elongate plate members of the second I-beam structure; and b) with the second I-beam structure fixed at an angle to one of the first I-beam structures.

20. The support structure of claim 19 wherein the angle with which the second I-beam structure is fixed to the first I-beam structure is a right angle.

21. The support structure of claim 19 wherein the second I-beam structure is fixed to and between two first I-beam structures.

22. The support structure of claim 19 wherein the support structure comprises a floor portion engaging the first and second I-beam structures, with the floor portion being openable such that at least a portion of the channel receiver is exposable whereby a wall portion may be mounted in the portion of the channel receiver when exposed.

23. The support structure of claim 19 and further comprising, in combination: first and second wall portions, with the first wall portion being engaged by the L-shaped receiver of the first I-beam structure, with the second wall portion being engaged by the channel receiver of the second I-beam structure, and with the first and second wall portions engaging each other.

24. The support structure of claim 23 wherein the first and second wall portions interlock with each other.

25. The support structure of claim 19 and further comprising, in combination: at least two of the second I-beam structures running parallel to each other.

26. The support structure of claim 25 and further comprising, in combination: at least another second I-beam structure running at a right angle and engaging the second I-beam structures which run parallel to each other.

27. A support structure in combination with a shelter comprising:

a) a plurality of I-beams, with each of the I-beams comprising an elongate web with upper and lower edges, upper and lower flanges fixed on the upper and lower edges, respectively, and an elongate plate member fixed to and running between the flanges and parallel to the elongate web, with the elongate plate member extending upwardly beyond the upper flange;

b) wherein some of the I-beams run about a perimeter of the shelter;

c) wherein some of the I-beams extend between and engage said I-beams which run about the perimeter;

d) wherein some of the I-beams are spaced from the I-beams which run about the perimeter of the shelter, with said I-beams which are spaced engaging said I-beams which extend between said I-beams which run about the perimeter;

e) wherein at least two of the I-beams engage each other at an angle; and f) at least two wall portions, with one of the wall portions on one of said at least two I-beams which engage each other at an angle and with the other of the two wall portions on said other at least two I-beams which engage each other at an angle, and with the wall portions interlocking each other.

28. A support structure in combination with a shelter comprising:

a) a plurality of I-beams, with each of the I-beams comprising an elongate web with upper and lower edges, upper and lower flanges fixed on the upper and lower edges, respectively, and an elongate plate member fixed to and running between the flanges and parallel to the elongate web, with the elongate plate member extending upwardly beyond the upper flange;

b) wherein some of the I-beams run about a perimeter of the shelter;

c) wherein some of the I-beams extend between and engage said I-beams which run about the perimeter;

d) wherein some of the I-beams are spaced from the I-beams which run about the perimeter of the shelter, with said I-beams which are spaced engaging said I-beams which extend between said I-beams which run about the perimeter;

e) wherein at least two of the I-beams engage each other at an angle;

f) wherein at-least two of the I-beams confront each other end to end and are disposed in line with each other; and g) wherein the shelter includes a post and a rafter engaged to the post, and with the post being disposed where said two I-beams confront each other end to end to distribute load from the rafter to each of said two I-beams which confront each other end to end.

29. A support structure in combination with a shelter comprising:

a) a plurality of I-beams, with each of the I-beams comprising an elongate web with upper and lower edges, upper and lower flanges fixed on the upper and lower edges, respectively, and an elongate plate member fixed to and running between the flanges and parallel to the elongate web, with the elongate plate member extending upwardly beyond the upper flange;

b) wherein some of the I-beams run about a perimeter of the shelter;

c) wherein some of the I-beams extend between and engage said I-beams which run about the perimeter;

d) wherein some of the I-beams are spaced from the I-beams which run about the perimeter of the shelter, with said I-beams which are spaced engaging said I-beams which extend between said I-beams which run about the perimeter;

e) wherein at least two of the I-beams engage each other at an angle; and f) wherein the shelter includes a floor portion engaged on at least some of the I-beams running about the perimeter of the shelter, on at least some of the I-beams which extend between said I-beams which run about the perimeter, and on at least some of the I-beams which are spaced from the I-beams which run about the perimeter, with the floor portion having a section which is openable to form a slot in the floor portion and expose at least an elongate portion of the upper flange of at least one of the I-beams.

* * * * *